US006809655B1

(12) United States Patent
Colby

(10) Patent No.: US 6,809,655 B1
(45) Date of Patent: Oct. 26, 2004

(54) MULTI-MODE SIGNAL

(76) Inventor: Steven M. Colby, P.O. Box 52033, Santa Clara, CA (US) 94303

( * ) Notice: Subject to any disclaimer, the term of this patent is extended or adjusted under 35 U.S.C. 154(b) by 51 days.

(21) Appl. No.: 10/206,871

(22) Filed: Jul. 26, 2002

Related U.S. Application Data

(60) Provisional application No. 60/308,229, filed on Jul. 26, 2001.

(51) Int. Cl.[7] ..... G08G 1/095

(52) U.S. Cl. ..... 340/907; 340/815.45; 340/815.65

(58) Field of Search ..... 340/907, 908.1, 340/464, 478, 479, 473, 815.42, 815.45, 815.47, 815.53, 815.65, 815.75, 916, 931, 932; 362/231, 234

(56) References Cited

U.S. PATENT DOCUMENTS 3,622,980 A * 11/1971 Elledge, Jr. ..... 340/908
5,619,194 A * 4/1997 Belfer ..... 340/907
5,663,719 A 9/1997 Deese et al.
5,715,619 A 2/1998 Polisois et al.
5,822,711 A * 10/1998 Ochoa-Chavez ..... 340/932
5,833,355 A 11/1998 You et al.
5,850,126 A 12/1998 Kanbar
5,898,381 A 4/1999 Gartner et al.
6,072,407 A 6/2000 Shin
6,195,016 B1 * 2/2001 Shankle et al. ..... 340/815.42
6,244,727 B1 6/2001 Ryan, Jr. et al.
6,473,002 B1 * 10/2002 Hutchison ..... 340/907

* cited by examiner

*Primary Examiner*—Van Thanh Trieu
(74) *Attorney, Agent, or Firm*—Steven M. Colby

(57) ABSTRACT

Systems and methods of controlling traffic including a traffic signal. The traffic signal including one or more lamps configured to each display a plurality of patterns by selectively powering different groups of bulbs. Embodiments of the invention include lamps configured to alternatively display an arrow pattern, a filled circle pattern, a bar pattern or other pattern meaningful to traffic control. The pattern displayed is optionally dependant on available power sources, ambient light, traffic flow, time of day or day of week.

61 Claims, 21 Drawing Sheets

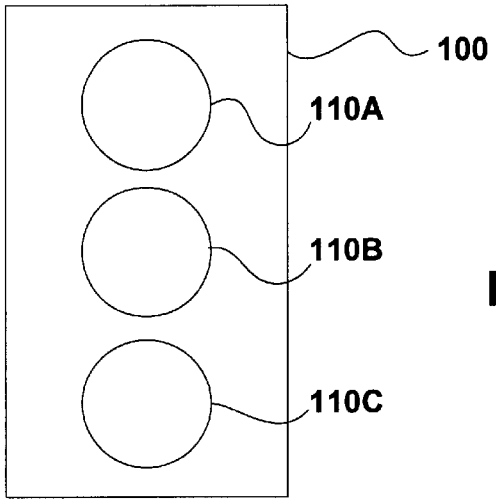
FIG. 1
Prior Art
FIG. 3
Prior Art
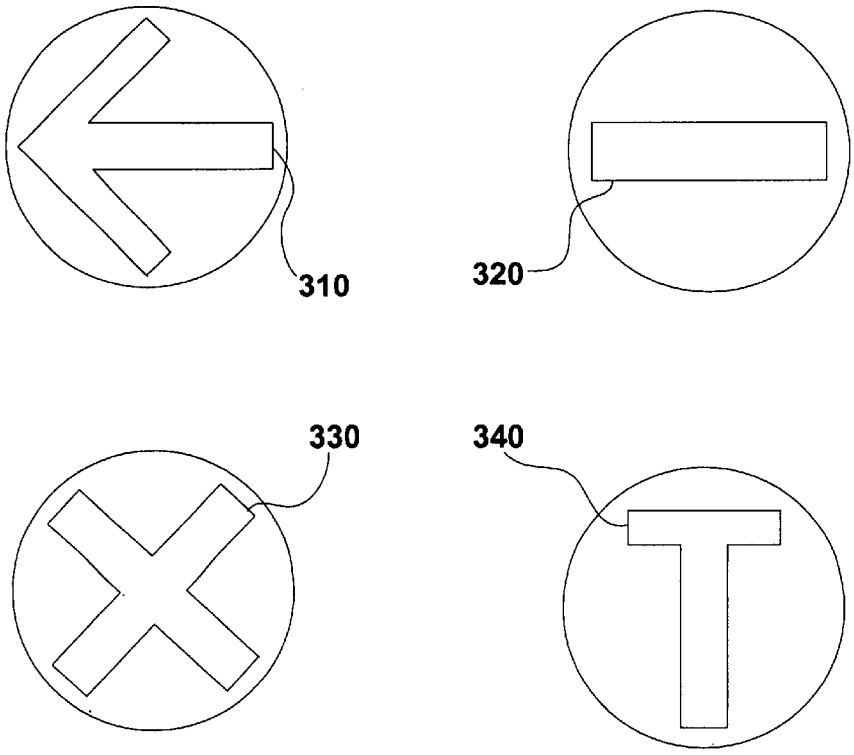

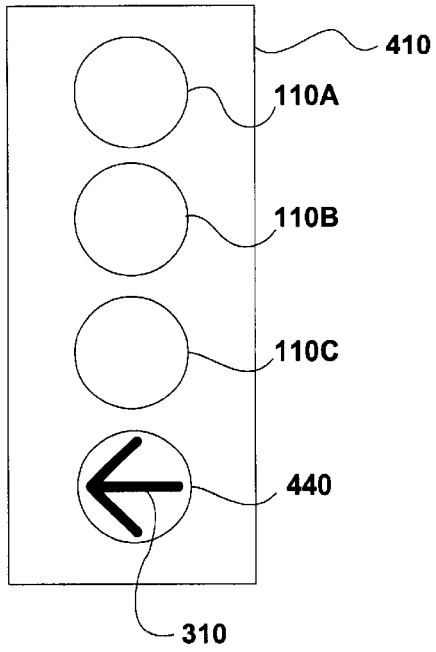
FIG. 4A
Prior Art
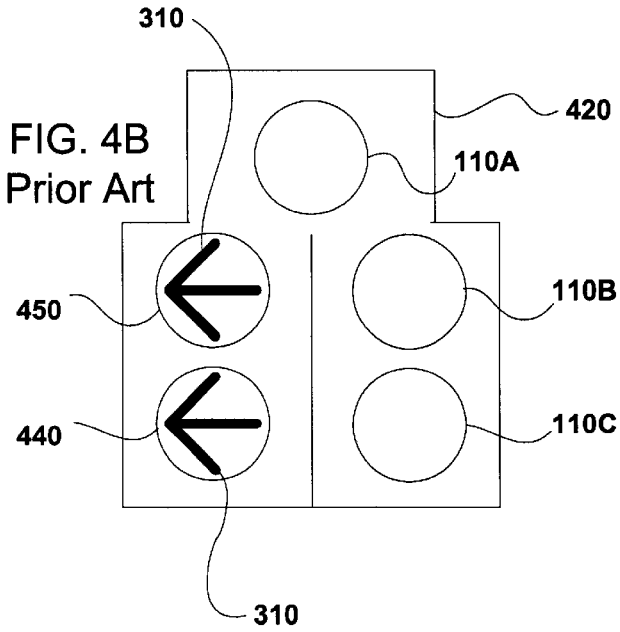
FIG. 4B
Prior Art
FIG. 4C
Prior Art
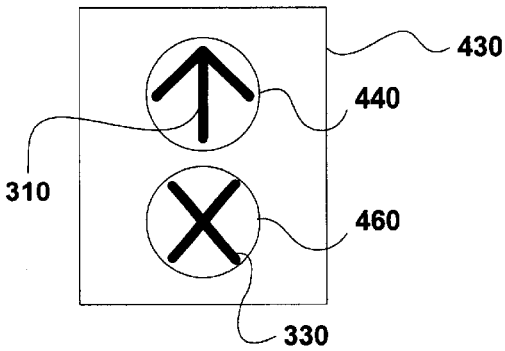

MULTI-MODE SIGNAL

CROSS-REFERENCE TO RELATED APPLICATIONS

This application claims benefit from commonly owned U.S. Provisional Patent Application No. 60/308,229 entitled "Multi-mode Signal," filed Jul. 26, 2001. The disclosure of this provisional patent application is incorporated herein by reference.

BACKGROUND

1. Field of the Invention

The invention is in the field of signaling and specifically in the field of traffic control using signal lights.

2. Background

FIG. 1 illustrates a prior art traffic signal 100 typically including three or more lamps 110A–110C. In a standard format these lamps are co-linear, shine with distinguishable colors red, yellow, and green, and display a filled circle pattern. When mounted vertically the red lamp is by convention (in the United States) located above the yellow and green lamps. As shown in FIG. 2A, each lamp 110 includes a single bulb 210 or alternatively, as shown in FIG. 2B, a series of bulbs 220 such as LEDs (light emitting diodes). Lamp 110 may also includes an optional lens (not shown) that modifies the apparent color of a bulb 210 or series of bulbs 220. For example a red lamp 110 may have a red lens that makes light from the lamp appear red in color.

Lamp 110 optionally has a pattern (mask or shape) that forms a pattern meaningful to traffic control, such as an arrow or a default filled circle pattern, in a lit surface. FIG. 3 illustrates four of these patterns, in addition to the default filled circle pattern, having different meaning to traffic control. An arrow pattern 310 is used for directional control. A bar pattern 320 and a "T" pattern 340 are used to control rail traffic. A cross pattern 330 is used in a variety of applications such as traffic direction control. Each pattern is rotated to other orientations and is used with a variety of colors. Both pattern and color determine the function of an individual lamp 110 meaningful to traffic control.

FIGS. 4A through 4C illustrate variations of prior art traffic signal 100. Advanced traffic signal 410 includes a green lamp 440 with an arrow pattern 310 used for direction control. In the figures, lamp 110, not showing a specific pattern, are meant to illustrate a default filled circle pattern. Advanced traffic signal 420 includes a yellow lamp 450 with arrow pattern 310 used for direction control. Advanced traffic signal 430 includes a red lamp 460 with a cross pattern 330 and a green lamp 440 with an arrow pattern 310 rotated ninety degrees. Advanced traffic signal 430 is used for lane control. Advanced variations of traffic signal 110, such as those illustrated, can include three or more lamps. A large number of lamp 110 in traffic signal 100 is a disadvantage. Each lamp 110 contributes to the cost and weight of traffic signal 100. Prior art lamp 110 does not have variable patterns that allow an individual lamp to provide variable information meaningful to traffic control displays. For example as a signal cycles through a display pattern, wherein alternative lamps are lit, a light pattern on an individual lamp cannot be changed from a default filled circle pattern to an arrow pattern 310 of the same color. Lamps 440, 450, and 460 are variations of lamp 110.

Prior art traffic signals are supported by supporting elements such as poles and cables. The weight of the traffic signal is a factor in the requirements and, therefore, cost of the support elements. In a typical installation several traffic signals are supported by one or more supporting elements and coupled through a single control module including electronics.

BRIEF DESCRIPTION OF THE VARIOUS VIEWS OF THE DRAWING

FIG. 1 illustrates a prior art traffic signal;

FIG. 3 illustrates four prior art patterns used for traffic control;

FIGS. 4A through 4C illustrate variations of a prior art traffic signal;

SUMMARY OF THE INVENTION

Figure 2A:
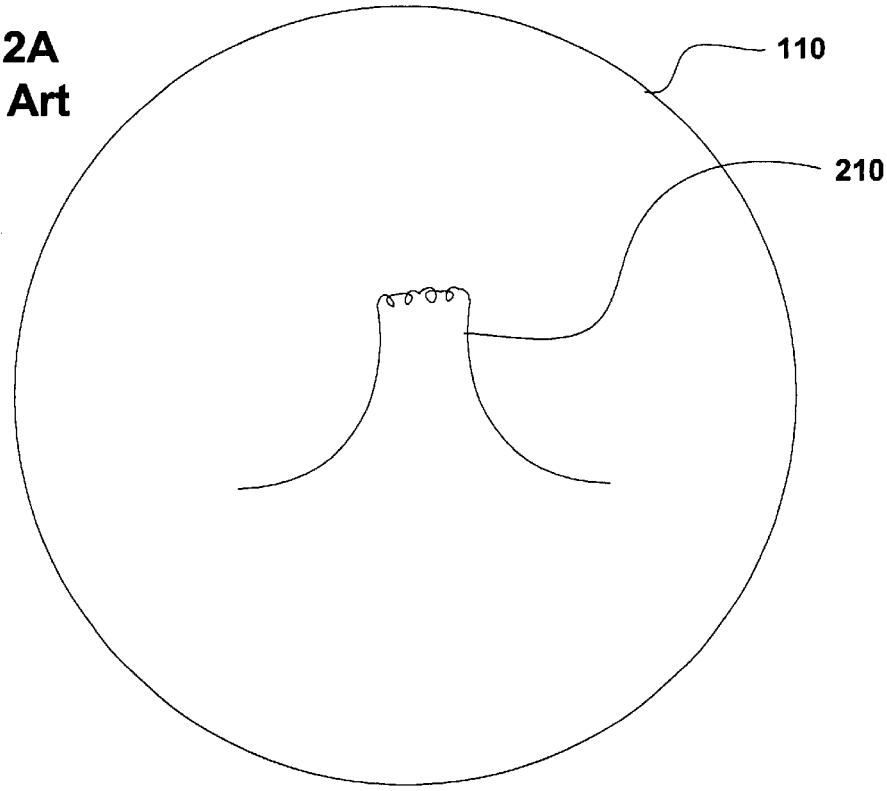
FIG. 2A Prior Art
FIG. 2A illustrates a prior art lamp including a single bulb.
Figure 2B:
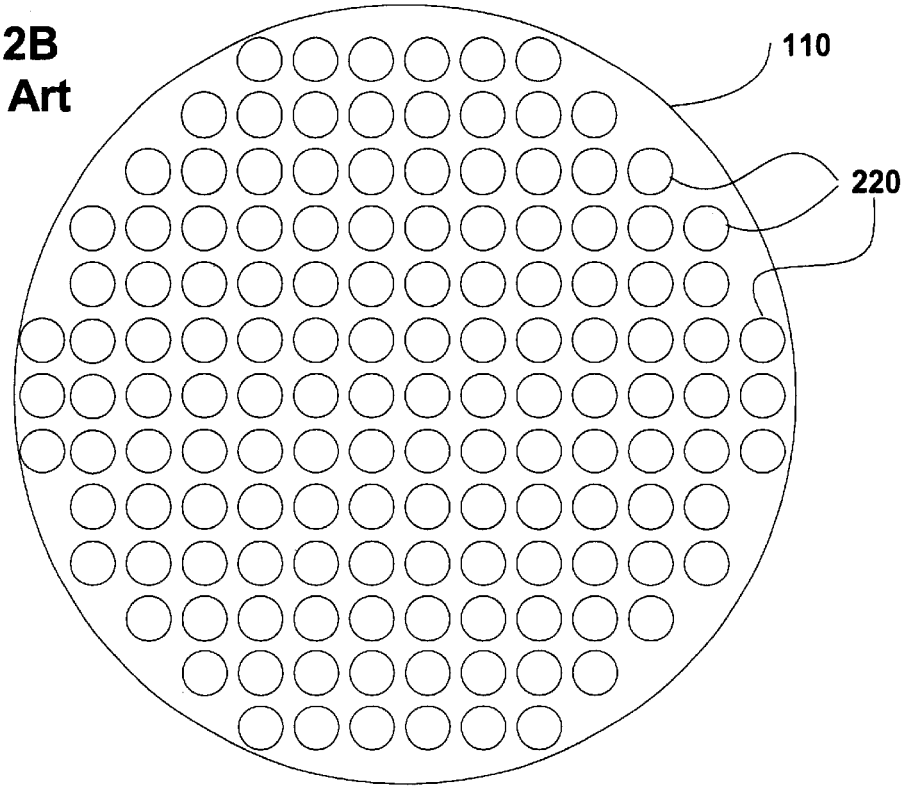
FIG. 2B Prior Art
FIG. 2B illustrates a prior art lamp including a series of bulbs, such as LEDs.

A traffic signal includes a lamp configured to present a plurality of light patterns optionally using shared bulbs. A single lamp with a variable light pattern enables the number of lamps in a traffic signal to be reduced without decreasing the utility of the traffic signal.

Variable light patterns are achieved by separately controlling different bulbs within a single lamp. A single bulb is optionally used as a component of more than one alternative pattern. In some embodiments, commonly used patterns, such as an arrow and a filled circle, are alternatively displayed in a single lamp.

Some embodiments of the invention include a traffic signal comprising a support structure, a housing supported by the support structure, an electronic circuit, a first lamp at least partially contained within the housing, a second lamp at least partially contained within the housing and configured to display, responsive to the electronic circuit, a plurality of patterns having a plurality of meanings to traffic control.

Some embodiments of the invention include a traffic signal comprising a first housing, a first group of bulbs disposed within the first housing, a second group of bulbs disposed within the first housing and having at least one bulb in common with the first group of bulbs, a first lamp at least partially contained within the first housing and including the first group of bulbs and the second group of bulbs, each of the first group of bulbs and the second group of bulbs being disposed to display a different pattern meaningful to traffic control, and an electronic circuit configured to control a state of bulbs in the first group separately from bulbs in the second group.

Some embodiments of the invention include a traffic signal comprising a support structure, a housing supported by the support structure, a first lamp at least partially contained within the housing, a second lamp at least partially contained within the housing, an electronic circuit including a plurality of switches, with on/off positions configured to control the second lamp, a first on/off state of the plurality of switches configured such that the second lamp displays a first pattern meaningful to traffic control, and a second on/off state of the plurality of switches configured such that the second lamp displays a second pattern meaningful to traffic control.

Some embodiments of the invention include a traffic signal comprising a first housing, an electronic circuit, a first lamp at least partially contained within the first housing, a second lamp at least partially contained within the first housing and configured to display a plurality of patterns having different meanings to traffic control, the second lamp being responsive to the electronic circuit, a color of the displayed pattern being deducible using the position of the second lamp relative to the first lamp.

Some embodiments of the invention include a traffic signal comprising a housing, a group of bulbs disposed to display a pattern meaningful to traffic control, a lamp at least partially contained within the housing and including the group of bulbs, an array of lenses, including more than one lens, disposed to direct light generated by the group of bulbs, and an electronic circuit configured to control the group of bulbs.

Some embodiments of the invention include a method of controlling traffic including the steps of supporting a traffic signal having a plurality of lamps, placing the traffic signal in a first state in which a first lamp, of the plurality of lamps, displays a first pattern meaningful to traffic control, and, placing the traffic signal in a second state in which the first lamp displays a second pattern meaningful to traffic control, the second pattern being either a filled circle pattern, an arrow pattern, a bar pattern, a "T" pattern, a polygon pattern, or a cross pattern.

Some embodiments of the invention include a method of controlling traffic including the steps of placing a traffic signal in a first state in which a first lamp, at least partially contained within a housing, displays a filled green circle and a second lamp, at least partially contained within the housing, displays no lit pattern, placing the traffic signal in a second state in which the first lamp displays a green arrow, and the second lamp displays a filled red circle, and placing the traffic signal in the first state again.

Some embodiments of the invention include a method of controlling traffic including the steps of placing a traffic signal in a first state in which a first lamp, at least partially contained within a housing, displays a filled green circle, and a second lamp, at least partially contained within the housing, displays a red arrow, and placing the traffic signal in a second state in which the first lamp displays a green filled circle and the second lamp displays no lit pattern.

Some embodiments of the invention include a method of attracting attention to a traffic signal comprising the steps of supporting a traffic signal having a plurality of lamps, a first lamp of the plurality of lamps including two or more separately controllable bulb groups, each bulb group configured to display essentially the same color and including more than one bulb, placing the traffic signal in a first state in which the first lamp displays a pattern meaningful to traffic control, and powering one of the separately controllable bulb groups on and off without changing the meaning of the pattern displayed by the first lamp.

DETAILED DESCRIPTION OF THE INVENTION

Figure 5A:
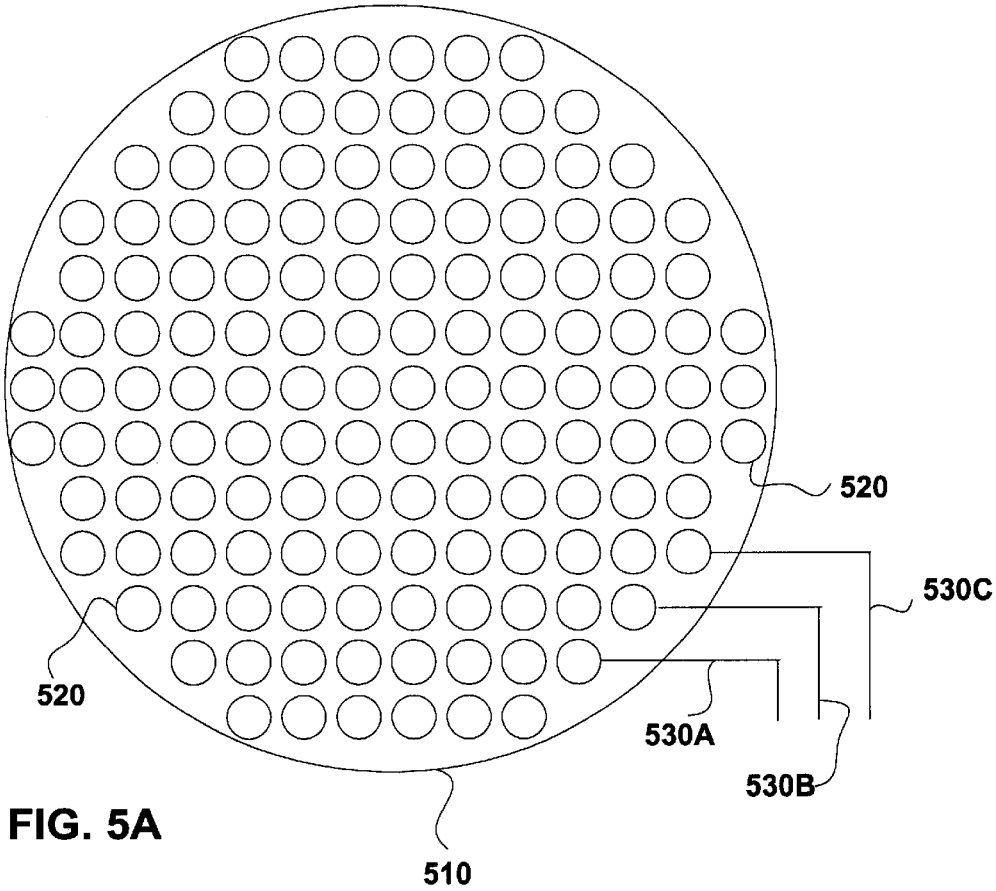
FIG. 5A illustrates an embodiment of a lamp including a plurality of bulbs, according to the invention.
Figure 5B:
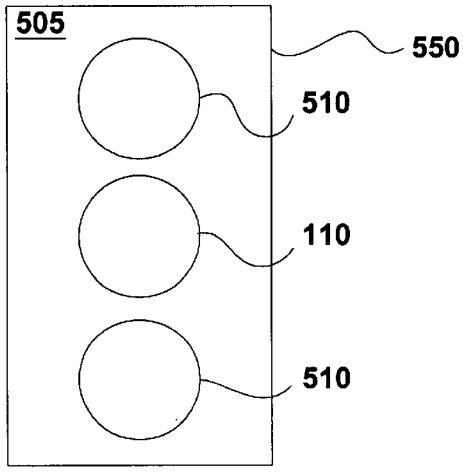
FIG. 5B illustrates an embodiment of a traffic signal including a housing and one or more lamp.

FIG. 5A illustrates an embodiment of a lamp 510, including a plurality of bulbs 520, according to the invention. Bulbs 520 are, for example, LEDs and are coupled to a plurality of electronic connections 530A–530C separately controllable. In some embodiments illumination of all bulbs in lamp 510 produces a filled circle pattern (such as seen in a red stop light). In some embodiments each lamp 510 displays light of specific color, such as green, red or yellow (amber). The color of lamp 510 is used in combination with standard patterns to convey specific meaning to specific traffic control. Variations in color, such as yellow and amber, that convey the same traffic control meaning are considered to be essentially the same color. FIG. 5B illustrates an embodiment of a traffic signal 550 including a housing 505 and one or more lamp 510 at least partially contained within housing 505.

Figure 6A:
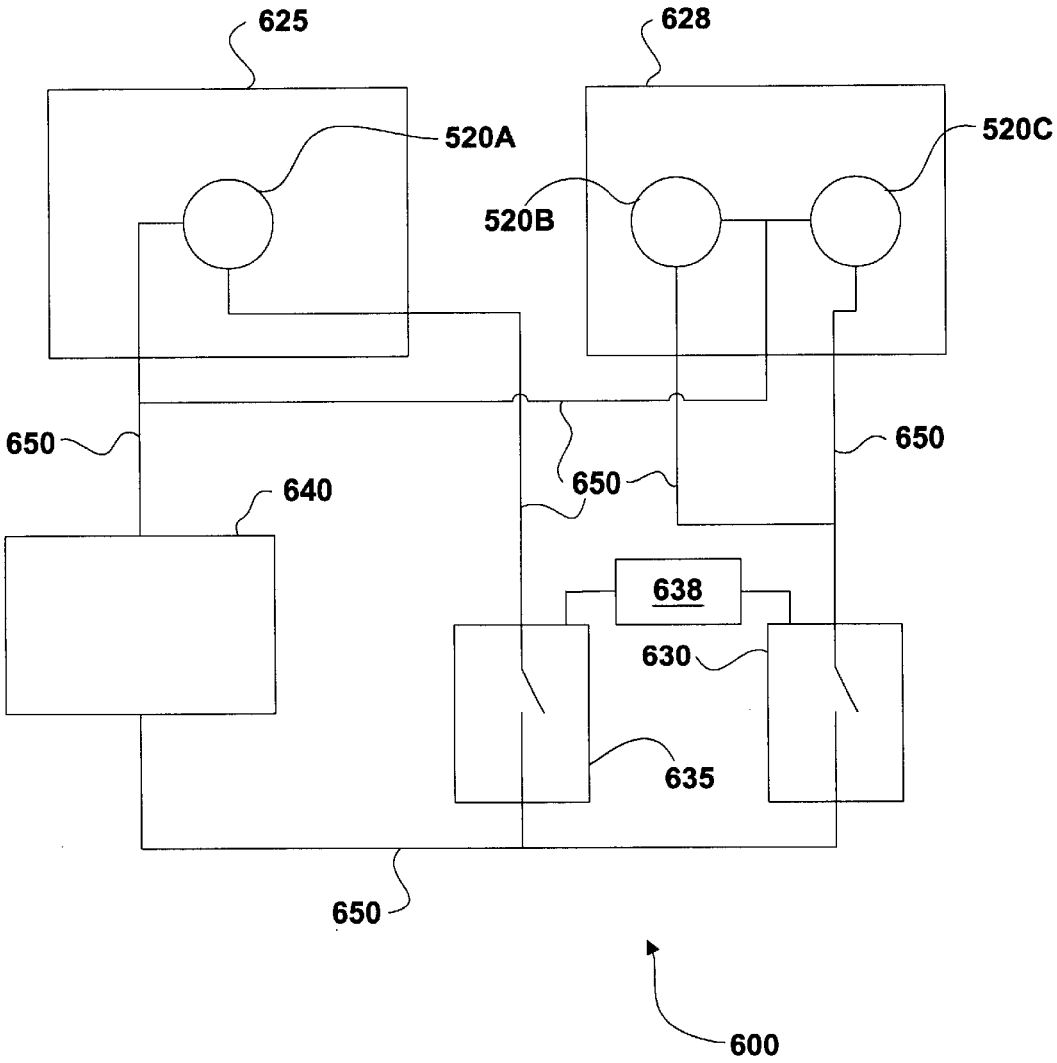
FIG. 6A illustrates an electronic circuit configured to separately control a plurality of bulbs.

FIG. 6A illustrates an electronic circuit, generally designated 600, including electrical connections 650 and configured to separately control a plurality of bulb 520, such as found in lamp 510. The plurality of bulb 520, included in lamp 510, are in two or more separately controllable bulb groups 625 and 628. Each of bulb group 625 and bulb group 628 are separately controlled through a switch 630 and a switch 635 respectively. Switch 630 and switch 635 have on/off states and are electronically controlled by a switch controller 638. The on/off states of switch 630 and switch 635 are configured to determine lit/unlit states of bulb 520 in bulb group 625 or bulb group 628. A power source 640 supplies power to electronic circuit 600 including bulb 520. Bulb group 625 and bulb group 628 optionally share individual bulb 520. Thus, an individual bulb 520 may be a member of a plurality of bulb groups such as bulb group 625 and bulb group 628.

Figure 6B:
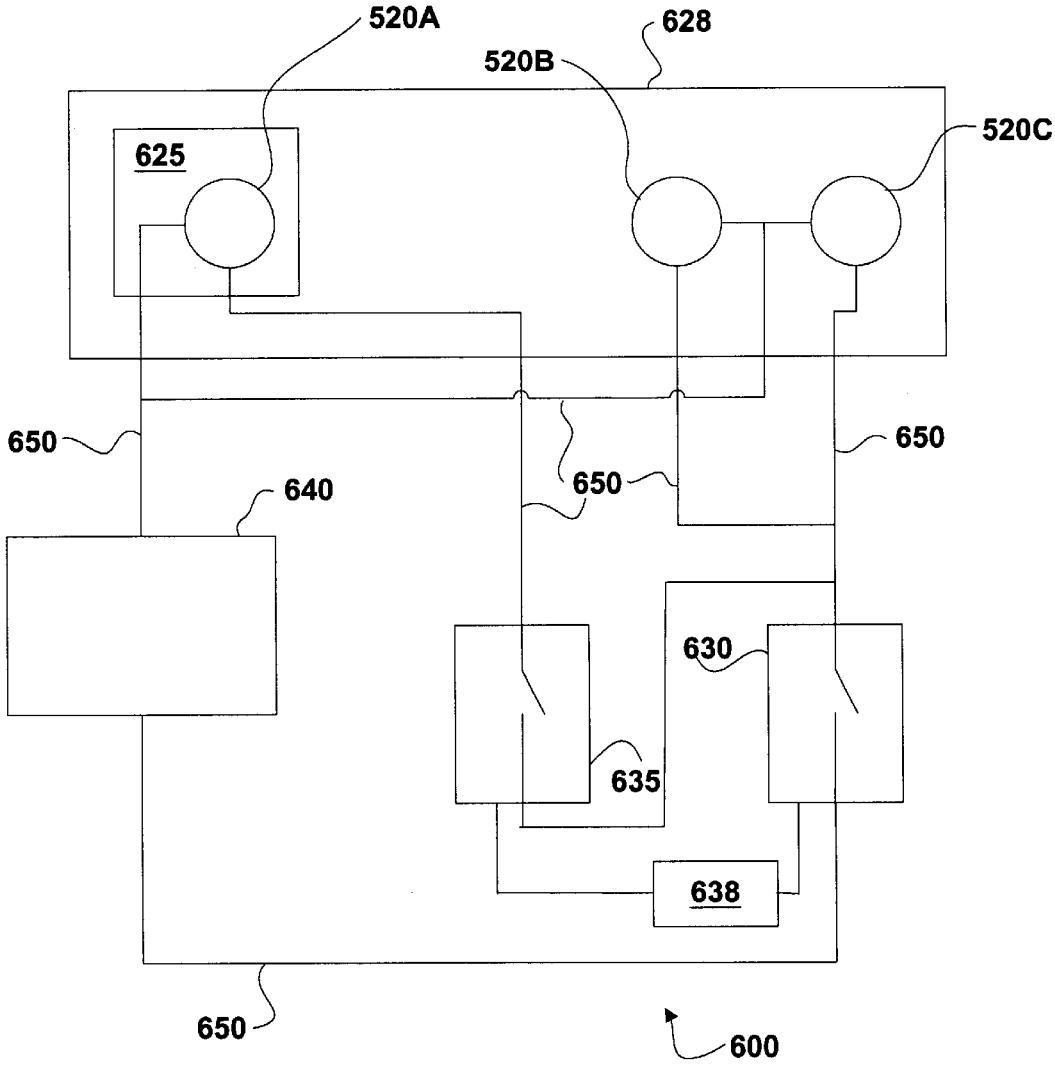
FIG. 6B illustrates an alternative embodiment of the electronic circuit in which two bulb groups are wired in series instead of in parallel.

FIG. 6B illustrates an alternative embodiment of electronic circuit 600 in which bulb group 625 and bulb group 628 are wired in series instead of in parallel. This embodiment is optionally used when bulb group 625 is a subset of bulb group 628.

Figure 6C:
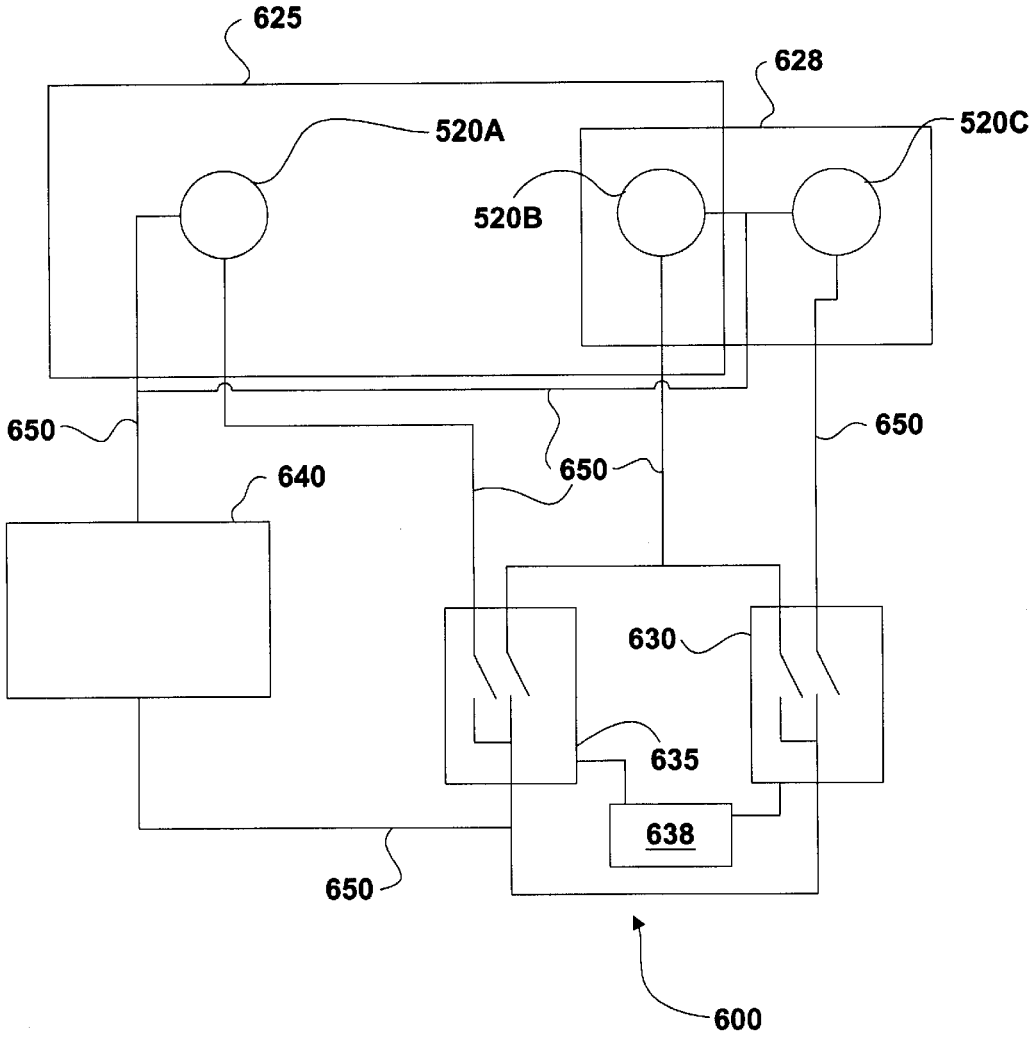
FIG. 6C illustrates an alternative embodiment of the electronic circuit wherein one bulb is a member of two bulb groups.

FIG. 6C illustrates an alternative embodiment of electronic circuit 600 wherein bulb 520B is a member of both bulb group 625 and bulb group 628. In this case, if either switch 630 or switch 635 is on then lamp 510B is lit.

In various embodiments bulb group 625 and bulb group 628 are disposed in useful patterns, such as those patterns illustrated in FIG. 3, meaningful to traffic control. In various embodiments of lamp 510 bulb group 625 and bulb group 628 are disposed in the same lamp 510 thus enabling a single lamp 510 to display a plurality of patterns meaningful to traffic control by selecting on or off states of switch 630 and switch 635.

FIG. 7 illustrates an embodiment of lamp 510 in which a filled circle and arrow are alternatively displayed. In FIG. 7 through FIG. 11, a circle 710 is used to indicate a bulb 520 that is a member of bulb group 625, a small triangle 720 (see FIG. 8A) is used to indicate a bulb 520 that is a member of bulb group 628, and a small square 730 is used to indicate a bulb 520 that is a member of both bulb group 625 and bulb group 628. These shapes are used for identification purposes only and are not meant to indicate a physical shape of any bulb 520. In addition, in all FIGs, a filled shape is used to indicate a lit bulb 520 and an empty shape is used to indicate an unlit bulb 520.

Figure 7A:
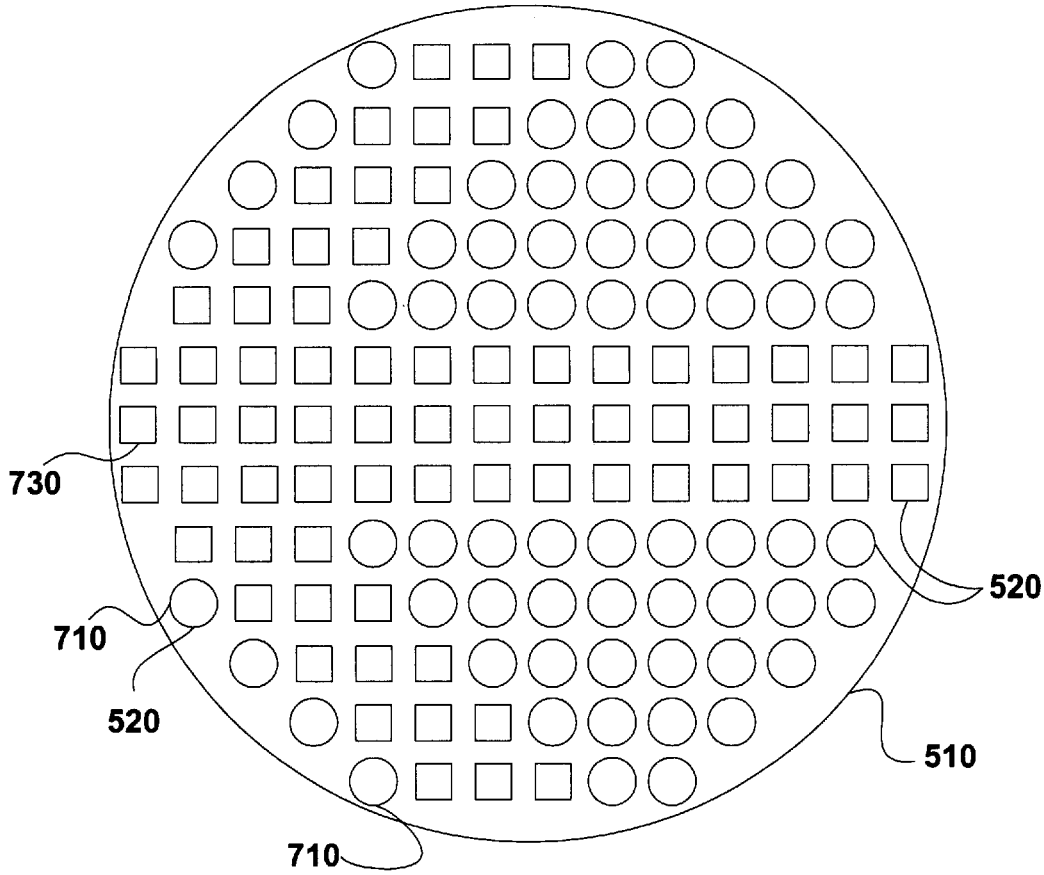
FIG. 7A illustrates a state of a lamp, according to an embodiment of the invention, wherein no bulb is lit.
Figure 7B:
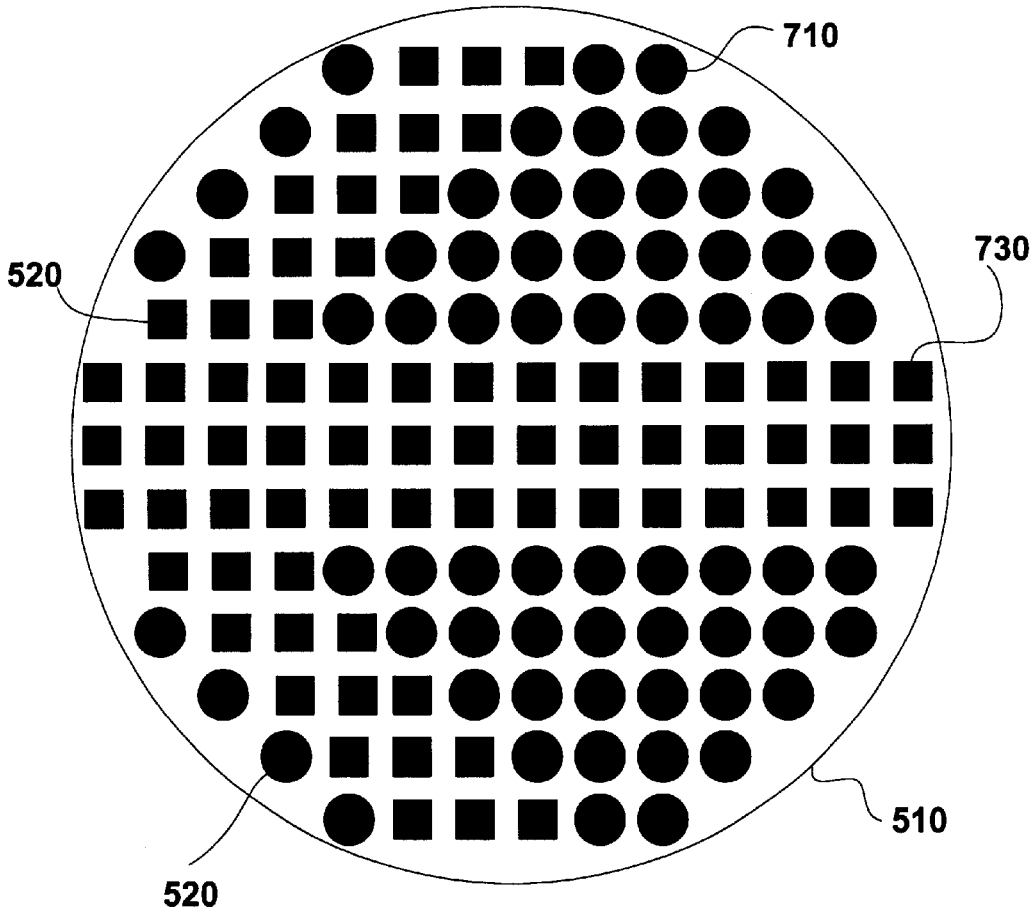
FIG. 7B illustrates a state of a lamp, according to an embodiment of the invention, wherein one bulb group is lit producing a pattern of a filled circle such as that found in a red stop lamp of a traffic signal.
Figure 7C:
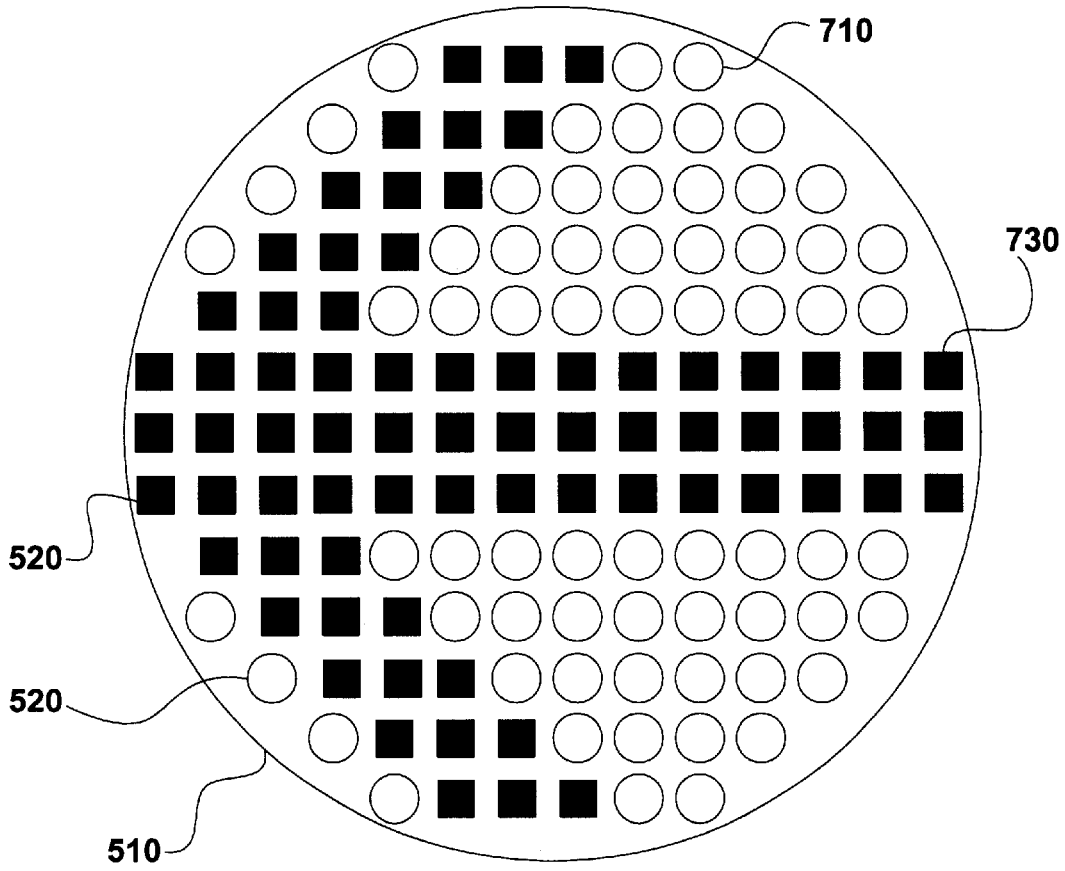
FIG. 7C illustrates a state of a lamp, according to an embodiment of the invention, wherein a bulb group is lit producing an image of an arrow such as that found in a red or green left turn lamp of a traffic signal.

FIG. 7A illustrates a state of lamp 510 wherein no bulb 520 is lit. FIG. 7B illustrates a state of lamp 510 wherein bulb group 625 is lit producing a pattern of a filled circle such as that found in a red stop lamp 510 of traffic signal 550. In this case all small circles 710 and small squares 730 representing bulb group 625 are filled. FIG. 7C illustrates a state of lamp 510 wherein bulb group 628 is lit producing an image of an arrow such as that found in a red or green left turn lamp 510 of a traffic signal 550. In this case all small squares representing bulb group 628 are filled (lit) but small circles representing bulb group 625 are not filled (unlit). The embodiment of lamp 510 shown in FIGS. 7A–7C displays an plurality of images using a single lamp 510 that, in the prior art, require a plurality of prior art lamp 110 to display. Bulb 520 is powered by a circuit, such as electronic circuit 600. Selection of the image displayed is made through switch 635, switch 630, or similar means. For example, in the embodiment shown illustrated in FIGS. 7A–7C and considering the embodiment of electronic circuit 600 shown in FIG. 6B, an arrow is displayed when switch 635 is on and a filled circle is displayed when switch 630 is also on. In the embodiment illustrated by FIGS. 7A–7C, where bulb group 628 is a subset of bulb group 625 the wiring of switch 635 and switch 630 is optionally serial, as shown in FIG. 6B, rather than in parallel. In most embodiments, each of bulb groups 625 and 628, within a specific lamp 510, includes one or more bulb 520 of essentially the same color. This enables a bulb 520 to be a member of more than one bulb group 625 or 628

Allowing an individual bulb 520 to be a member of more than one bulb group advantageously reduces the number of bulb 520, number of electrical connections, and the amount of supporting structure required. Traffic signal 550 maintains the expected positions of lamps 510 (red on bottom, green on top, etc. or left to right order) within traffic signal 550 while changing the patterns shown in each color. Maintaining standard positions allows the color of each lamp 510 to be deduced by viewers who are color blind. Allowing an individual bulb 520 to be a member of more than one bulb group 625 and 628 also allows alternative patterns to be presented with a number of bulb 520 less than the number that would be required to present both patterns with independent groups of bulbs.

Figure 8A:
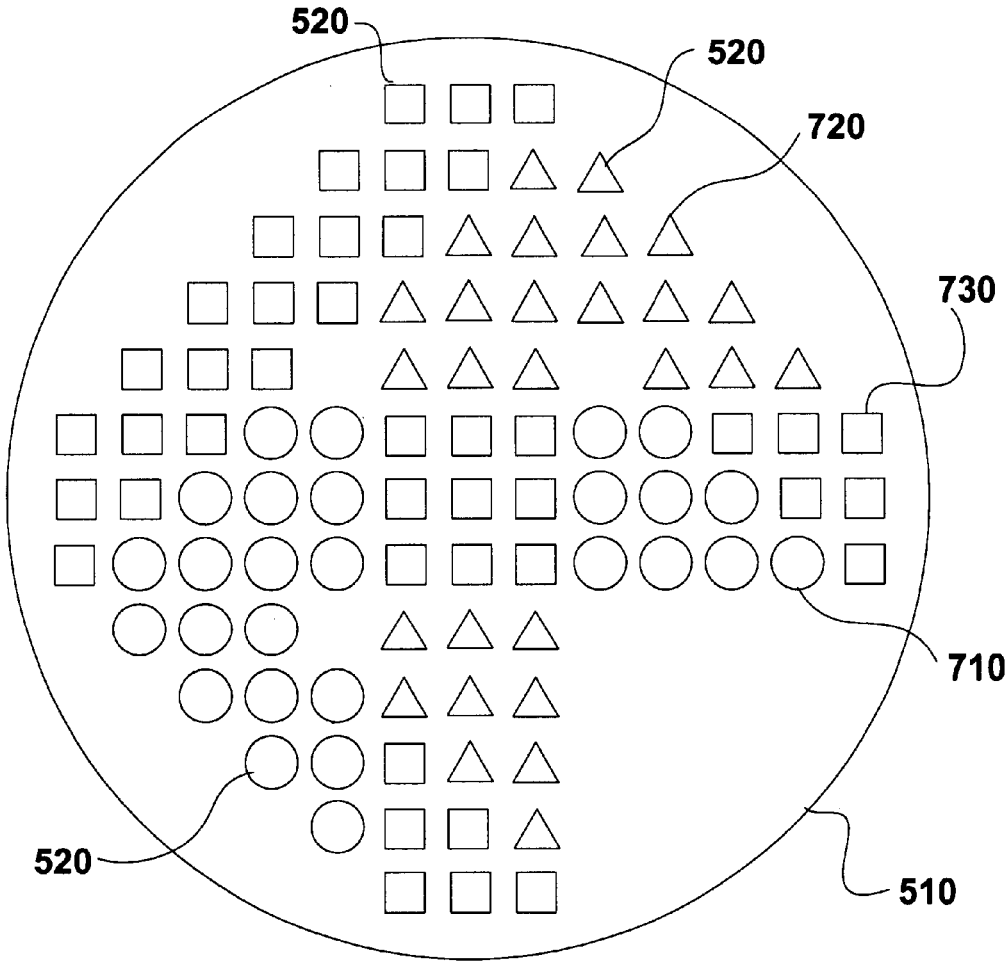
FIG. 8A illustrates an alternative embodiment of a lamp including a state in which two bulb groups are unlit.
Figure 8B:
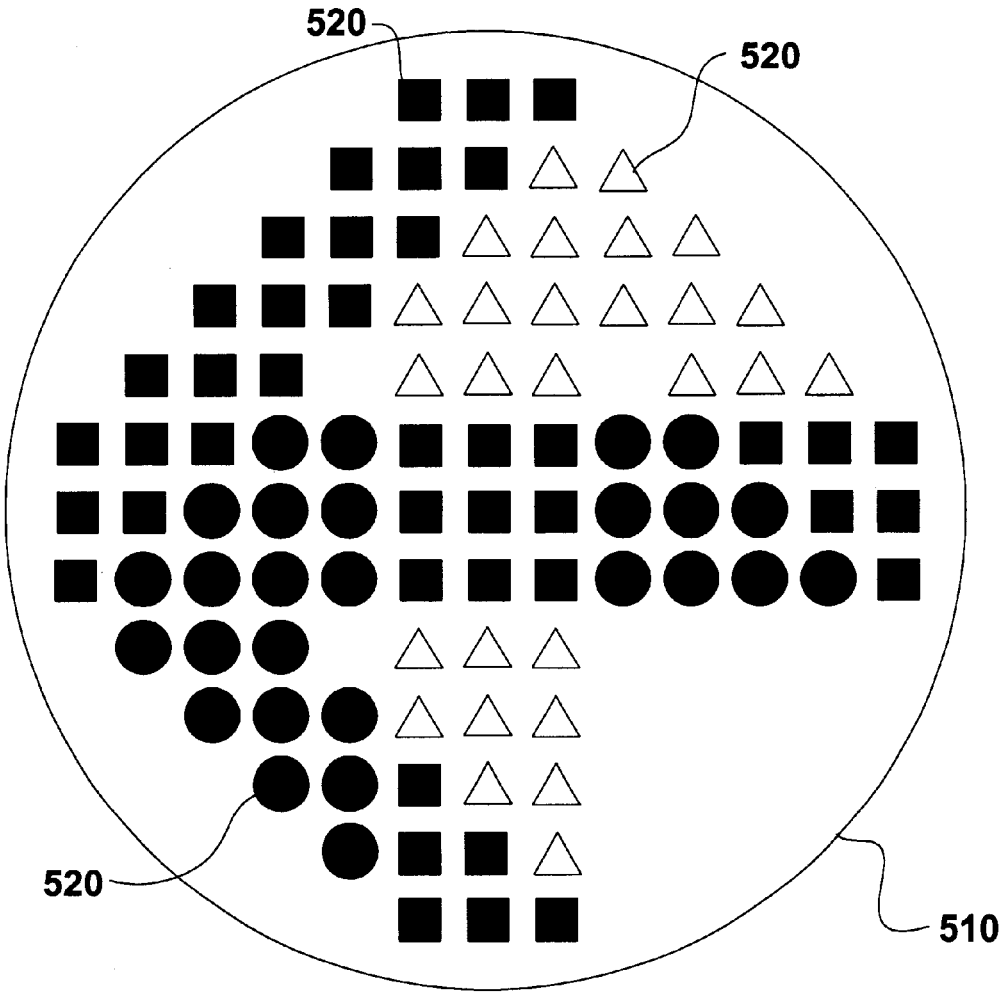
FIG. 8B illustrates an alternative embodiment of a lamp including a state in which a bulb group is lit and a bulb group is unlit.
Figure 8C:
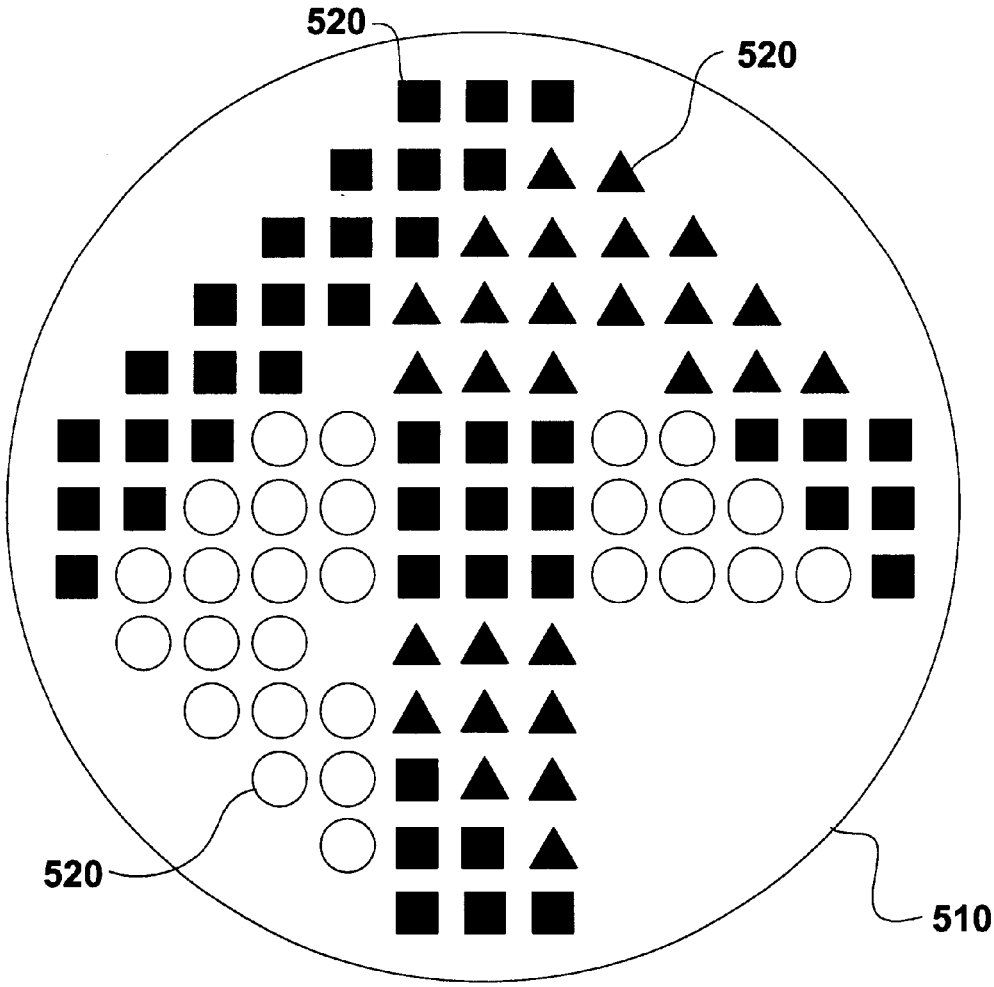
FIG. 8C illustrates an alternative embodiment of a lamp including a state in which a bulb group is unlit and a bulb group is lit.

FIGS. 8A–8C illustrate an alternative embodiment of lamp 510 in which bulb group 625 is not a subset of bulb group 628. This embodiment is controlled by a circuit such as the embodiment of electronic circuit 600 shown in FIG. 6C. FIG. 8A illustrates a state in which both bulb groups 625 and 628 are unlit. FIG. 8B illustrates a state in which bulb group 625 is lit and bulb group 628 is unlit. This state shows a solid arrow pointing to the left. FIG. 8C illustrates a state in which bulb group 625 is unlit and bulb group 628 is lit. This state shows a solid arrow pointing upward.

The embodiments illustrated by FIGS. 7 and 8 are illustrative. Bulb group 625 and bulb group 628 can each be arranged into any pattern meaningful to control traffic. Switch 635 and switch 630 are optionally included within traffic signal 550 or in a separate control module. More than two bulb groups are optionally included within a single lamp 510 and a plurality of lamp 510 is optionally included in traffic signal 550.

Figure 9:
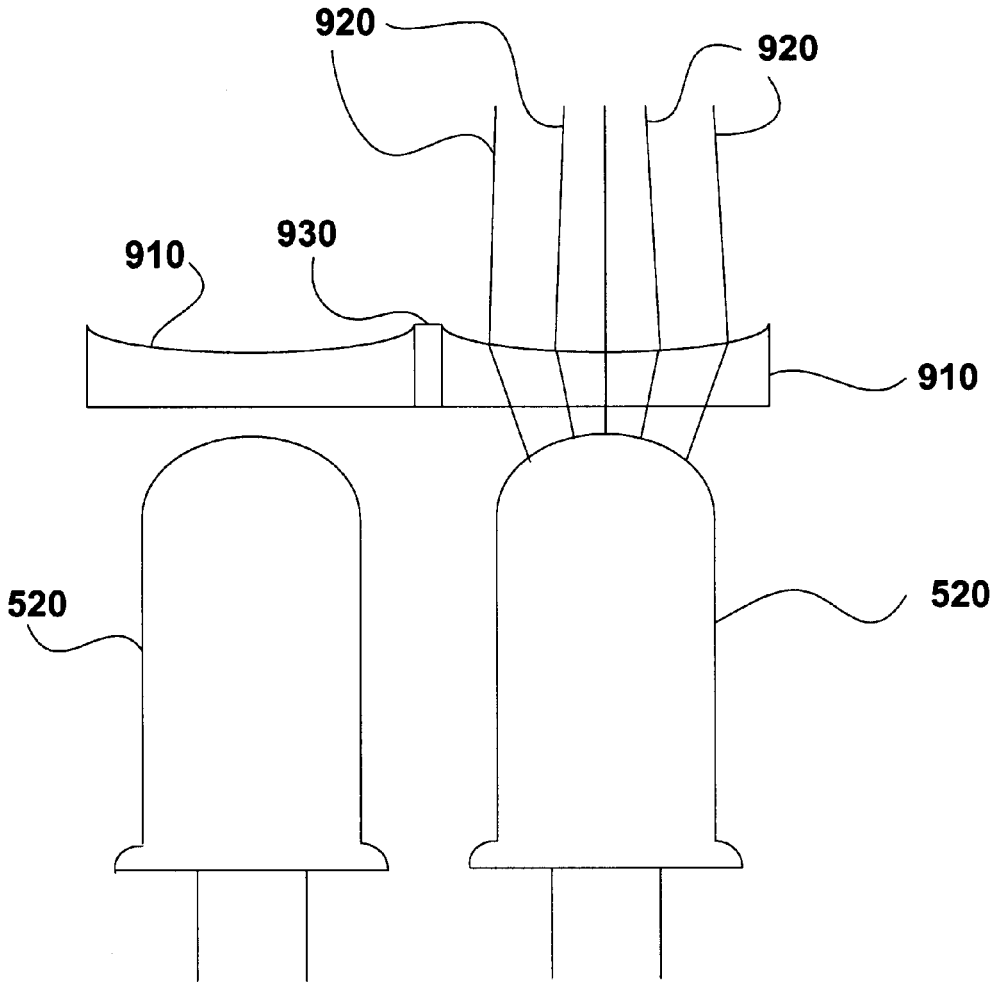
FIG. 9 illustrates an array of lenses, according to an embodiment of the invention, disposed to direct light generated by a bulb.

In one embodiment of the invention, illustrated by FIG. 9, a lens 910 is disposed to direct the light 920 generated by bulb 520. Each lens 910 directs the light of either one bulb 520 or a plurality of bulb 520. Lens 910 is included in an array of lenses 930 placed in front of an array of bulb 520. The direction that lens 910 directs the light of a bulb 520 is optionally a function of the bulb group 625 and/or 628 of which the bulb 520 is a member. Light generated by a member of bulb group 625 can, therefore, be directed in a direction different from light generated a member of bulb group 628. Array of lenses 930 optionally includes a lens for every bulb 520 in the array of bulb 520. Array of lenses 930 is optionally physically moved while traffic signal 550 is in operation in order to redirect the light of bulb 520. Since lens 910 is small and part of array of lenses 930, small movement (such as 1/10of the width of bulb 520) results in a large change in the direction of light 920. This amount of movement is optionally accomplished by small solid state actuators.

Figure 10A:
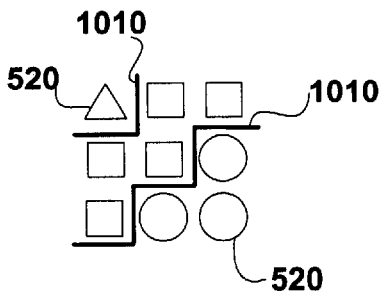
FIG. 10A illustrates an embodiment of a barrier wherein a minimal amount of the barrier is used to separate bulbs that are members of different bulb groups.
Figure 10B:
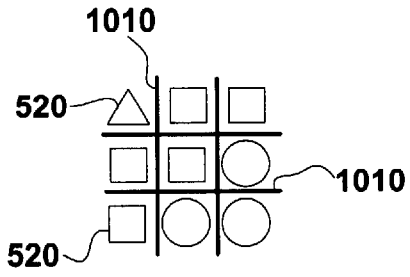
FIG. 10B illustrates an embodiment of a barrier wherein the barrier separates every bulb from every other bulb.
Figure 10C:
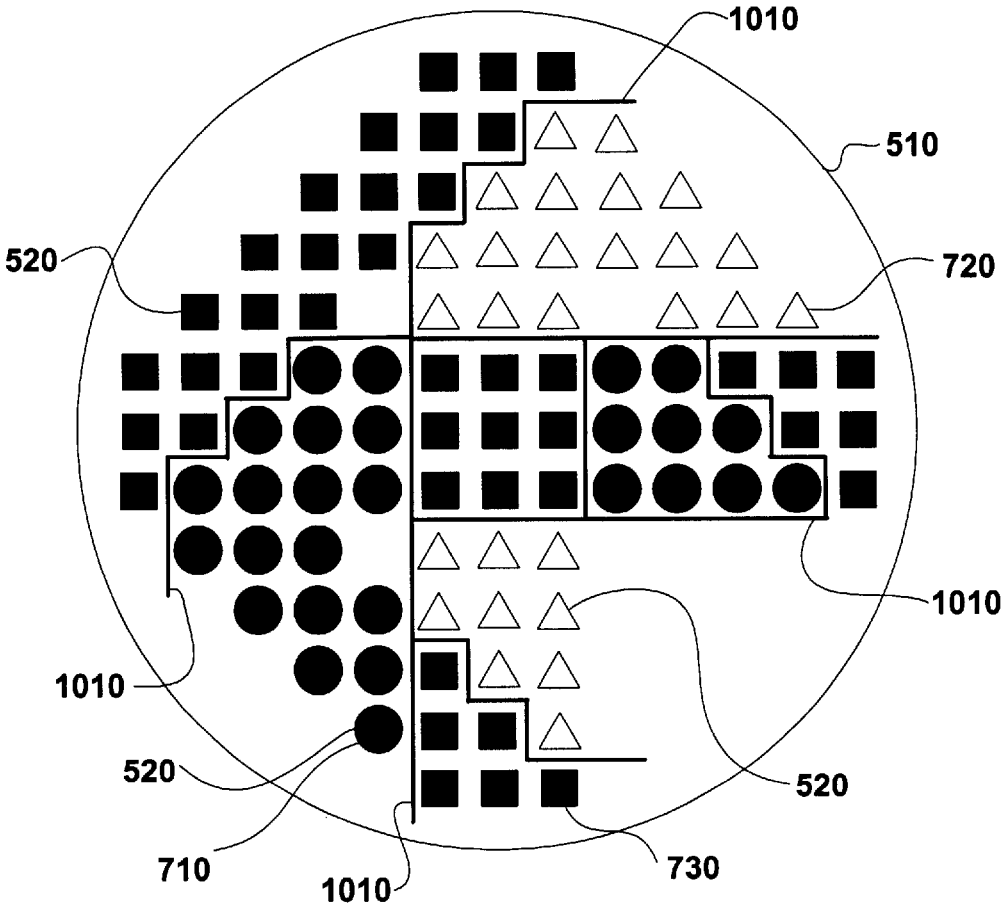
FIG. 10C illustrates an embodiment of a barrier wherein the barrier is used to separate bulbs that are members of different bulb groups, in a lamp illustrated in FIGS. 7A–7C

In one embodiment, illustrated in FIGS. 10A–10C, bulbs 520 that are members of only bulb group 625 are separated from bulbs 520 that are members of bulb group 628, by a barrier 1010 disposed to prevent light emitted from a member of bulb group 625 from striking and then scattering from a member of bulb group 628. Since light, first produced by a member of bulb group 625, is prevented from scattering from a member of bulb group 628 the visual separation between bulb groups 625 and 628 is enhanced. Barrier 1010 is preferably opaque or semi-opaque and can be a variety of shapes other than those shown in FIGS. 10A–10C. Barrier 1010 is optionally disposed to support bulb 520 and/or lens 910. FIG. 10A illustrates an embodiment of barrier 1010 wherein a minimal amount of barrier 1010 is used to separate bulb 520 that are members of different bulb groups 625 and 628. FIG. 10B illustrates an embodiment of barrier 1010 wherein barrier 1010 separates every bulb 520 from every other bulb 520. FIG. 10C illustrates an embodiment of barrier 1010 wherein barrier 1010 is used to separate bulb 520 that are members of different bulb groups 625 and 62.8, in the lamp 510 illustrated in FIGS. 7A–7C.

Figure 11A:
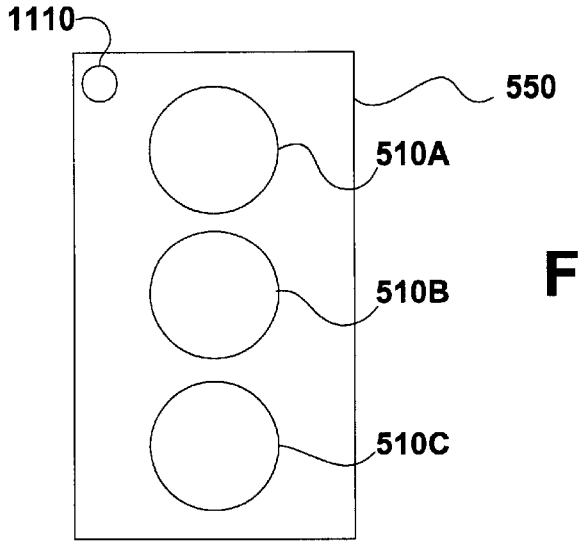
FIG. 11A illustrates an embodiment of a traffic signal including a photo-sensor used to regulate the brightness of a lamp.
Figure 11B:
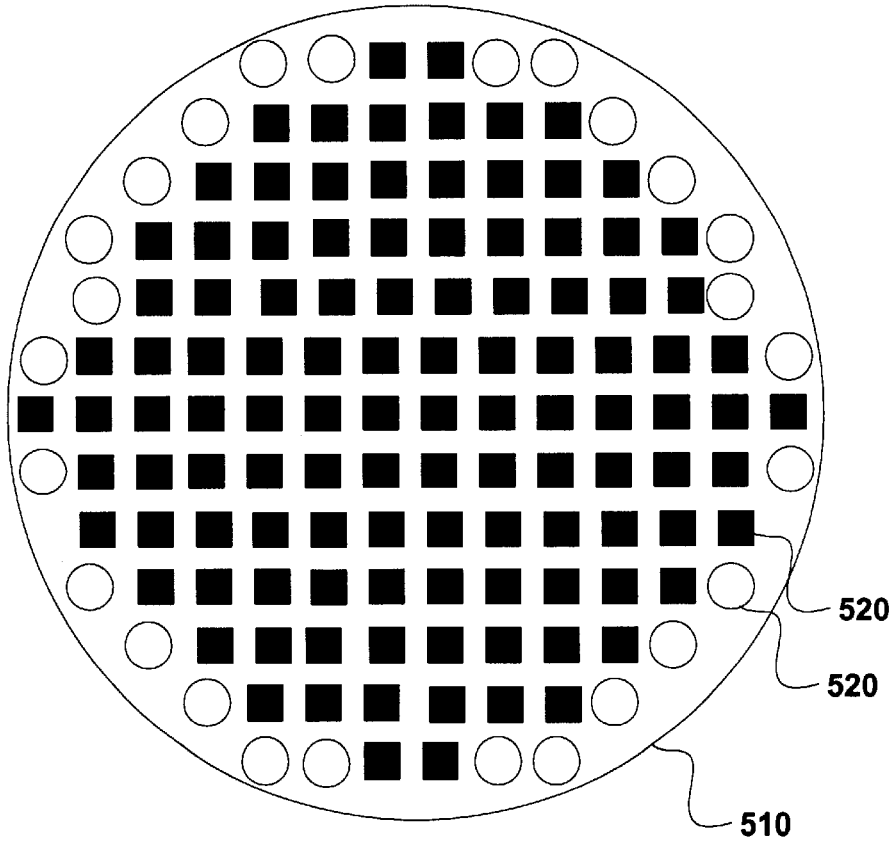
FIG. 11B illustrates how the brightness of a lamp is reduced, while still maintaining an image pattern shown by the lamp, by not lighting every fifth bulb used to produce the image pattern.

FIG. 11A illustrates an embodiment of traffic signal 550 including a photo-sensor 1110 used to regulate the brightness of lamp 510. The brightness of lamp 510 is regulated in response to ambient light detected by photo-sensor 1110 and is controlled by changing the brightness of bulb 520 and/or changing the number of bulb 520 within lamp 510 that are lit, in a lit state of lamp 510. For example, in one embodiment the brightness of a lamp 510 is reduced by not lighting twenty percent of the bulb 520 within lamp 510. This is accomplished, as shown in FIG. 11B, while still maintaining the meaning of the image pattern shown by lamp 510, by not lighting every fifth bulb 520 used to produce the image pattern. In this embodiment, the every fifth bulb 520 not lit is a member of bulb group 625 and the remaining bulbs are members of both bulb groups 625 and 628. Photo-sensor 1110 faces either the back or front of traffic signal 550 and detects the amount of light striking the front or back of traffic signal 550 respectively. In one embodiment photo-sensor 1110 faces the back of traffic signal 550 and increases the brightness of lamp 510 when bright light, such as sunlight, is striking the back of traffic signal 550 at an angle that makes viewing of lamp 510 difficult. The increase in brightness compensates for the difficulty in viewing and, therefore, increases the utility of traffic signal 550. Shielding (not shown) is used to make photo-sensor 1110 sensitive to an angle of incidence of the bright light striking traffic signal 550. Use of photo-sensor 1110 and shielding for brightness control is not limited to lamp 510. They are optionally also used to control the intensity of prior art lamp 110 by regulating the current or voltage that are provide to these lamps.

Embodiments of the invention include means for attracting attention to a traffic signal 550. Since individual bulbs 520 within lamp 510 are optionally separately controllable, a subset of bulb 520, including at least two bulb 520 and forming part of an image, is optionally turned on and off to attract attention to lamp 510 without changing the meaning of the displayed pattern. The bulbs turned on an off may comprise a bulb group, such as bulb group 625. For example, in one embodiment, in an image of a solid circle the bulbs 520 on the outer edge of the circle image are turned on an off rapidly. This action draws attention to the image while still enabling the display of a continuous solid circle shape, as shown in FIG. 11B. In alternative embodiments, the bulbs turned on and off are disposed in other positions within the filled circle. In an alternative embodiment the bulbs turned on and off are within a bulb group and are turned on and off in a sequential manner.

Figure 12:
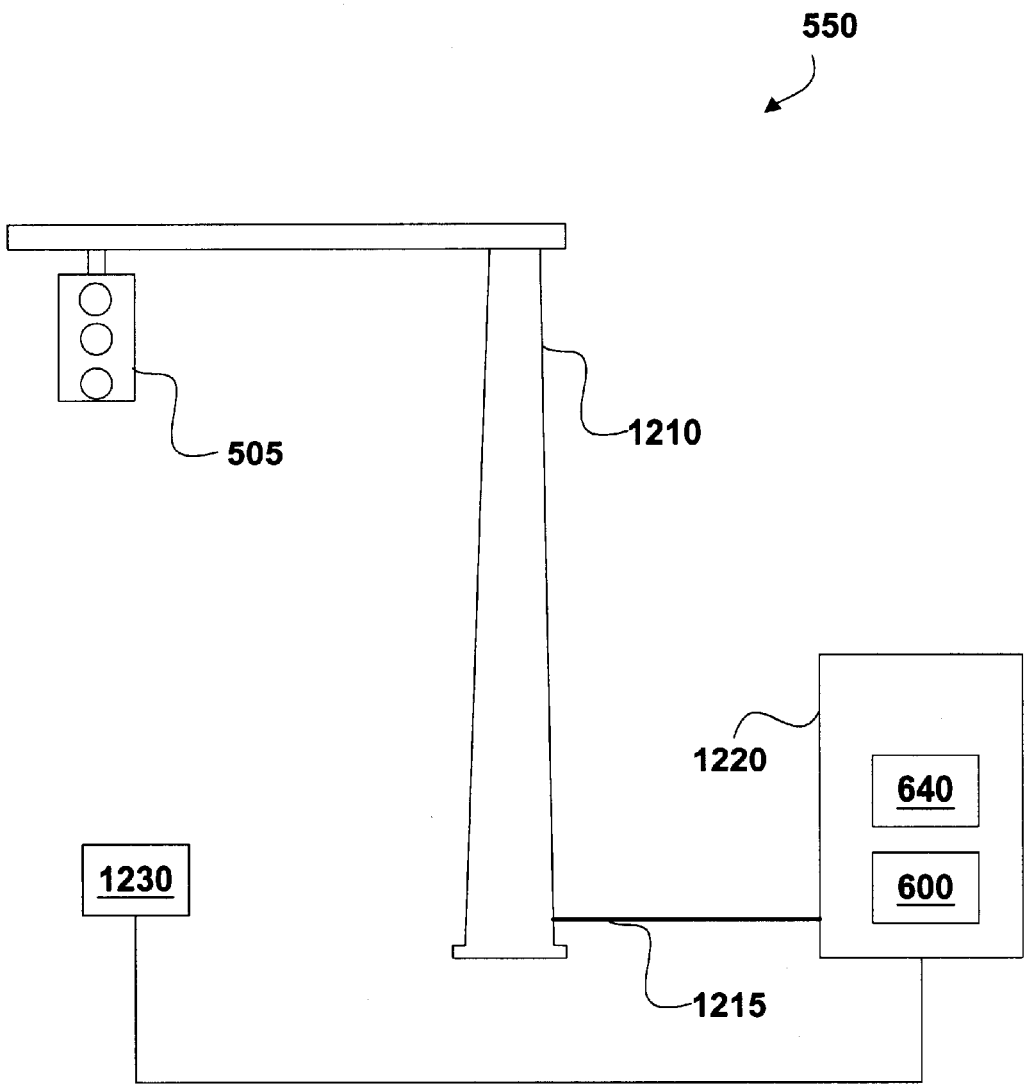
FIG. 12 illustrates an embodiment of a traffic signal supported by a support structure.

As shown in FIG. 12, an embodiment of traffic signal 550 includes a support structure 1210 configured to support one or more housing 505. Support structure 1210 is optionally electronically 1215 coupled to other support structure and housing 505 (not shown) and to an electronic console 1220 included in some embodiments of traffic signal 550. Support structure 1210 supports housing 505 and includes elements such as bars, tubes, wires, bridges, signs, poles, and the like. Electronic circuit 600 and/or power source 640 for powering each traffic signal 550 is optionally included in electronics console 1220. An intersection involving multiple flows of traffic is optionally controlled using a plurality of housing 505. The invention enables a reduction in the number of lamp 510 within each traffic signal and thus enables the used of support structure 1210 that can support less weight. Electronic console 1220 is optionally coupled to and responsive to a traffic sensor 1230 configured to determine the volume or flow of traffic. For example the traffic sensor is optionally used to determine the lit/unlit state of bulb group 625.

Figure 13:
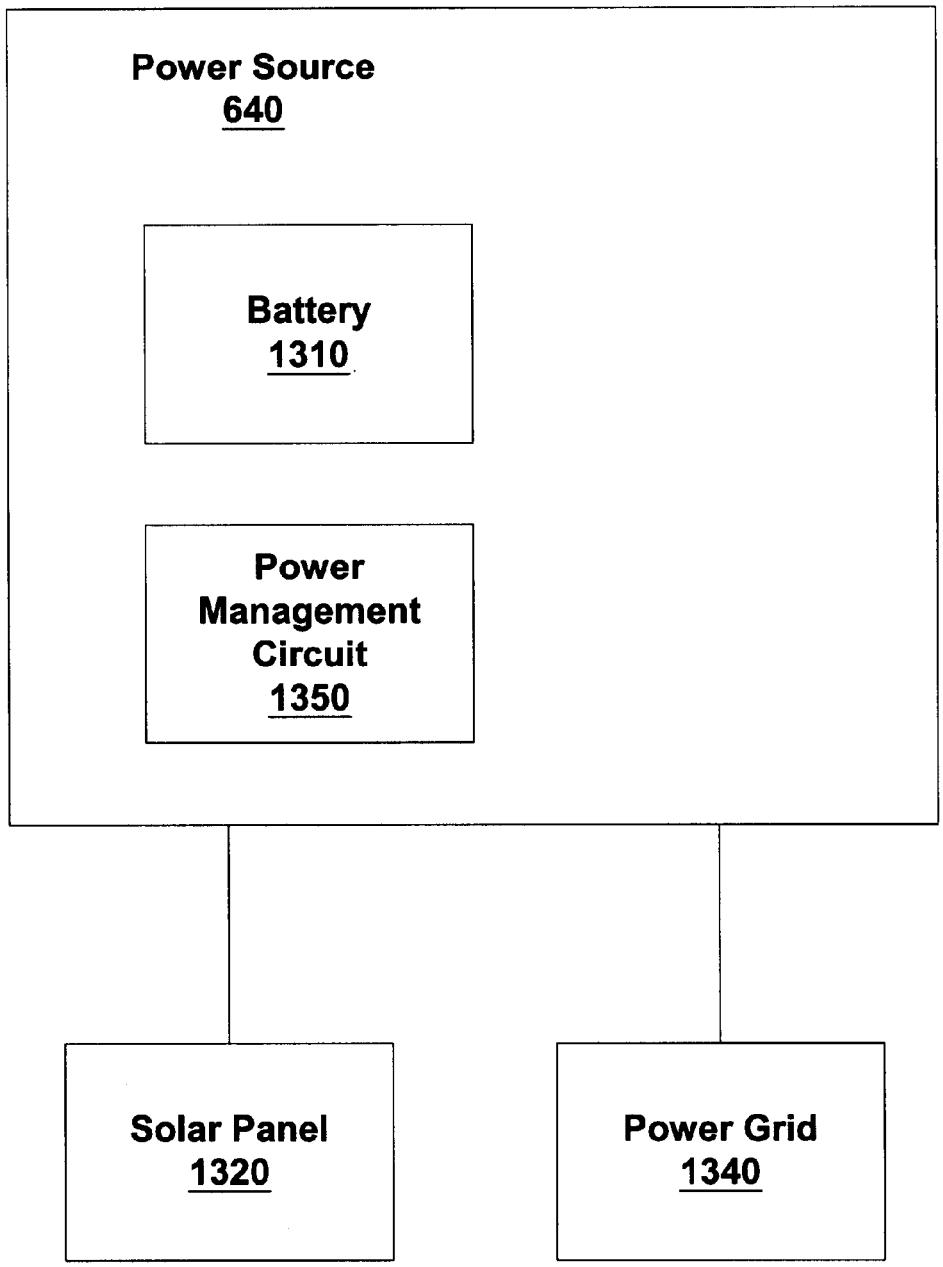
FIG. 13 illustrates an embodiment of a power source including a power management circuit, and a battery to provide power when other power sources are not available.

In one embodiment, illustrated by FIG. 13, power source 640 includes a power management circuit 1350, and a battery 1310 to provide power when other power sources are not available. Battery 1310 is charged by either a solar panel 1320 or an AC power grid 1340, when these sources are available to supply power. In the event of a failure in power grid 1340, battery 1310 provides backup power. Solar panel 1320 is optionally mounted on support pole 1210.

Power management circuit 1350 is used to conserve the power used by traffic signal 550 and to extend battery 1310 lifetime. Power management is responsive to the availability of power from power grid 1340 or an external signal such as a radio message. Power management circuit 1350 includes control of switches 630 and/or 635 enabling the power management circuit 1350 to turn off a bulb group 625 or 628 in order to conserve power. As shown in FIG. 11, in one embodiment one bulb group 625 or 628 can be turned off without changing the meaning of the pattern displayed. Power is alternatively conserved by regulating the current or voltage to a lamp 510. When voltage or current regulation is used, power management is optionally applied, by power management circuit 1350, to prior art lamps 110. In one embodiment the brightness of a prior art lamp 110 is reduced using power management circuit 1350 to conserve power and/or extend the lifetime of battery 1310.

In various embodiments the patterns displayed by lamp 510 are functions of additional factors such as the time of day, the day of the week, and traffic volume/flow detected by traffic sensor 1230. For example, in one embodiment, during a period of peak traffic volume, a pattern of a red left turn arrow 310 is displayed while at the same time another lamp 510 in the same traffic signal 550 displays a green up arrow. This state of traffic signal 550 indicates that traffic may move forward but left turns are not allowed. During a period of reduced traffic the same traffic signal 550 displays only a green filled circle indicating that traffic is allowed to move forward and also make a left turn.

Figure 14A:
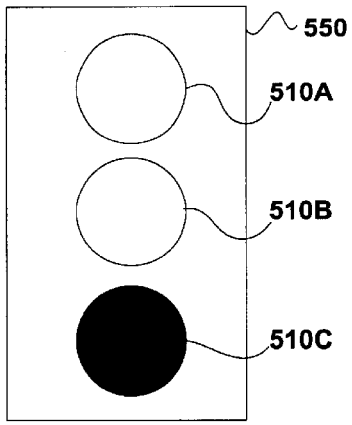
FIG. 14A illustrates a state of a traffic signal including an unlit red lamp, an unlit yellow lamp, and a lit green lamp with a pattern of a filled circle.
Figure 14B:
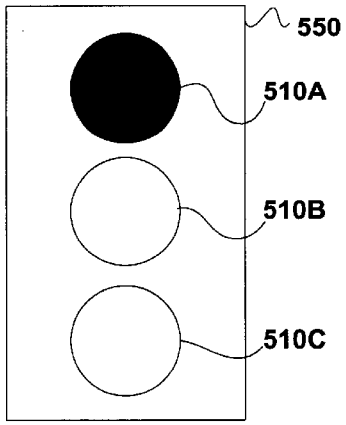
FIG. 14B illustrates a state of a traffic signal including a lit red lamp with a pattern of a filled circle, an unlit yellow lamp, and an unlit green lamp.
Figure 14C:
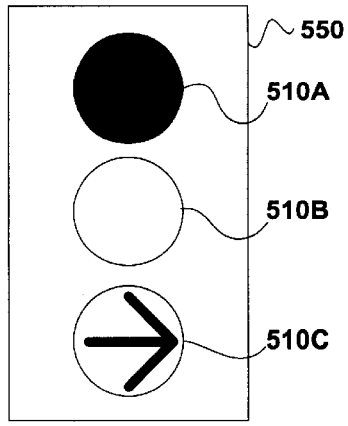
FIG. 14C illustrates a state of a traffic signal including a lit red lamp with a pattern of a filled circle, an unlit yellow lamp, and a lit green lamp with a pattern of a right arrow.
Figure 14D:
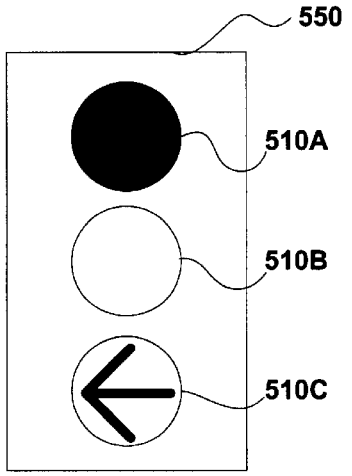
FIG. 14D illustrates a state of a traffic signal including a lit red lamp with a pattern of a filled circle, an unlit yellow lamp, and a lit green lamp with a pattern of a left arrow.
Figure 14E:
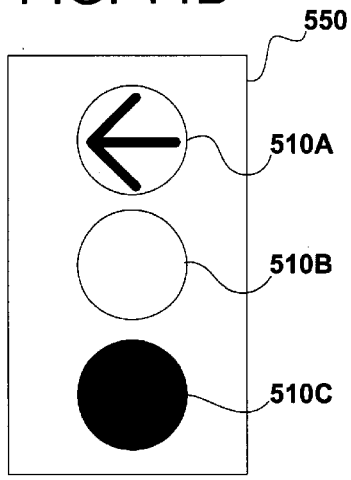
FIG. 14E illustrates a state of a traffic signal including a lit red lamp with a pattern of a left arrow, an unlit yellow lamp, and a lit green lamp with a pattern of a filled circle.
Figure 14F:
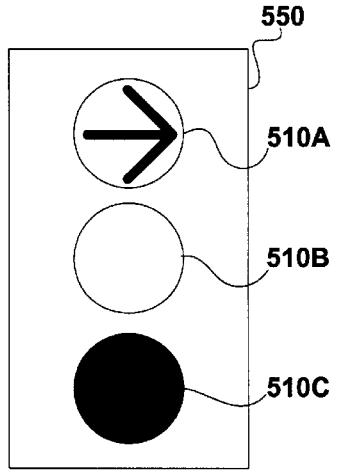
FIG. 14F illustrates a state of a traffic signal including a lit red lamp with a pattern of a right arrow, an unlit yellow lamp, and a lit green lamp with a pattern of a filled circle.
Figure 14G:
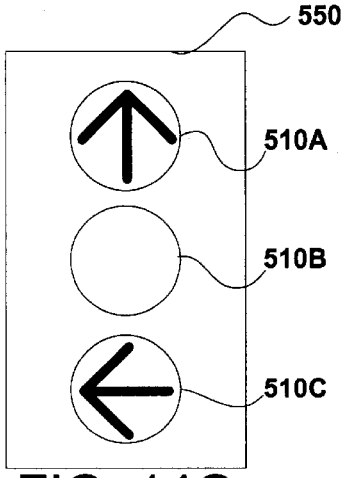
FIG. 14G illustrates a state of a traffic signal including a lit red lamp with a pattern of a up arrow, an unlit yellow lamp, and a lit green lamp with a pattern of a left arrow.
Figure 14H:
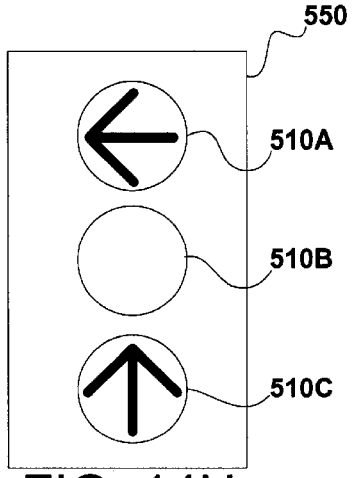
FIG. 14H illustrates a state of a traffic signal including a lit red lamp with a pattern of an left arrow, an unlit yellow lamp, and a lit green lamp with a pattern of an up arrow.
Figure 14I:
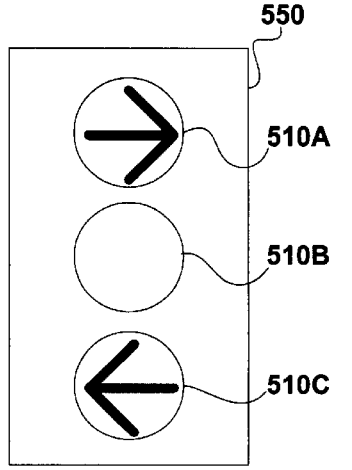
FIG. 14I illustrates a state of a traffic signal including a lit red lamp with a pattern of a right arrow, an unlit yellow lamp, and a lit green lamp with a pattern of a left arrow.

Examples of states of traffic signal 550 are illustrated by FIGS. 14A through 14K. Embodiments of traffic signal 550 are optionally configured to operate in any two or more of these states. The state shown in FIG. 14A includes an unlit red lamp 510A, an unlit yellow lamp 510B, and a lit green lamp 510C with a pattern of a filled circle. The state shown in FIG. 14B includes a lit red lamp 510A with a pattern of a filled circle, an unlit yellow lamp 510B, and an unlit green lamp 510C. The state shown in FIG. 14C includes a lit red lamp 510A with a pattern of a filled circle, an unlit yellow lamp 510B, and a lit green lamp 510C with a pattern of a right arrow. The state shown in FIG. 14D includes a lit red lamp 510A with a pattern of a filled circle, an unlit yellow lamp 510B, and a lit green lamp 510C with a pattern of a left arrow. The state shown in FIG. 14E includes a lit red lamp 510A with a pattern of a left arrow, an unlit yellow lamp 510B, and a lit green lamp 510C with a pattern of a filled circle. The state shown in FIG. 14F includes a lit red lamp 510A with a pattern of a right arrow, an unlit yellow lamp 510B, and a lit green lamp 510C with a pattern of a filled circle. The state shown in FIG. 14G includes a lit red lamp 510A with a pattern of a up arrow, an unlit yellow lamp 510B, and a lit green lamp 510C with a pattern of a left arrow. The state shown in FIG. 14H includes a lit red lamp 510A with a pattern of an left arrow, an unlit yellow lamp 510B, and a lit green lamp 510C with a pattern of an up arrow. The state shown in FIG. 14I includes a lit red lamp 510A with a pattern of a right arrow, an unlit yellow lamp 510B, and a lit green lamp 510C with a pattern of a left arrow. The state shown in FIG. 14I is possibly used at a "T" intersection. The state shown in FIG. 14J includes an unlit red lamp 510A, an unlit yellow lamp 510B, and a lit green lamp 510C with a pattern of a left arrow. The state shown in FIG. 14K includes a lit red lamp 510A with a pattern of a left arrow, an unlit yellow lamp 510B, and an unlit green lamp 510C. Alternative states (not shown) include displaying patterns in yellow lamp 510B, states designed to reduce power consumption, and states including flashing bulbs 520. Alternative states (not shown) include lamps 510 configured to display cross patterns, bar patterns, "T" patterns, polygon patterns (e.g. square, triangle, hexagon etc.) or the like. Some embodiments of housing 550 include no lamps configured to display numbers or letters of the English alphabet.

All of the states of lamp 510 discussed herein occur in embodiments of traffic signal 550 that include one or more lamp 510. Similar states occur in embodiments of traffic signal 550 including a combination of lamp 510 and lamp 110. Similar states also occur in embodiments of traffic signal 550 that include at least one lamp 510 and a total of more than three lamps including lamp 510 or lamp 110.

Figure 14J:
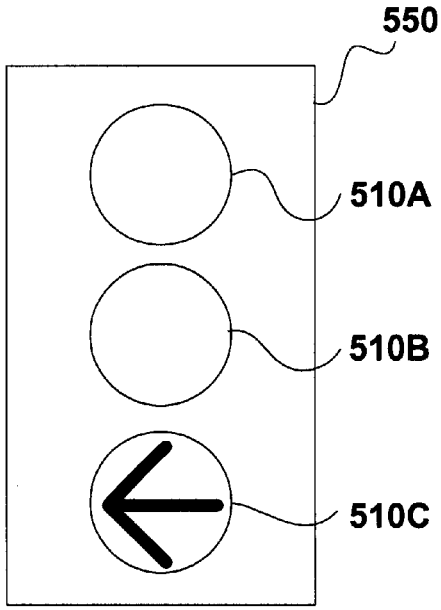
FIG. 14J illustrates a state of a traffic signal including an unlit red lamp, an unlit yellow lamp, and a lit green lamp with a pattern of a left arrow.
Figure 14K:
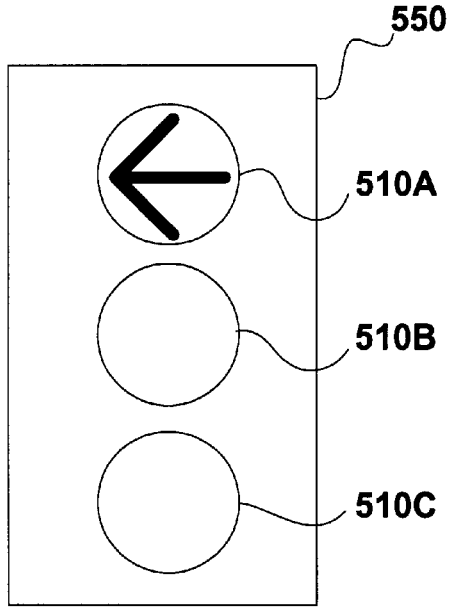
FIG. 14K illustrates a state of a traffic signal including a lit red lamp with a pattern of a left arrow, an unlit yellow lamp, and an unlit green lamp.
Figure 15:
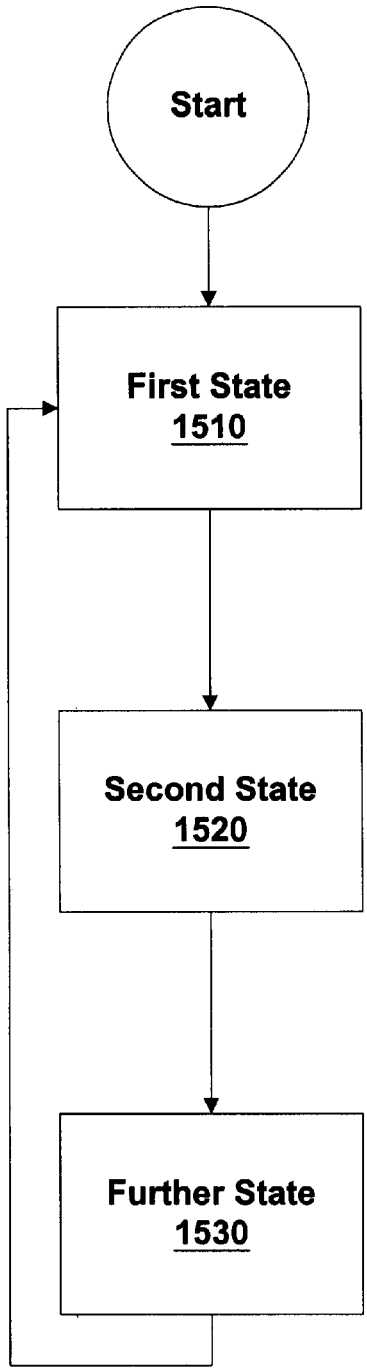
FIG. 15 illustrates an embodiment of a method of the invention.

FIG. 15 illustrates an embodiment of a method of the invention. In a first step 1510 a first state of traffic signal 550 is displayed. The first state can be any of the states possible for traffic signal 550, such as those illustrated in FIG. 14, or the like. In a second step 1520 a second state of traffic signal 550 is displayed. The second state can be any of the states possible for traffic signal 550, or the like, other than the first state. The method optionally includes displaying one or more further state of traffic signal 550 in a step 1530. Displaying the first state of step 1510 and the second state of step 1520 includes using an individual lamp 510 to display at least two different patterns. In one embodiment, the first state and the second state include the use of a specific lamp 510 to display more than one pattern. An example of this embodiment is found when the first and second state are illustrated by FIGS. 14A and 14J respectively. In another embodiment traffic signal includes three lamps including at least one lamp 510, wherein at least two of the three lamps are lit in the first state. An example of this embodiment is illustrated in FIG. 14E.

The identity of first state and second state optionally changes responsive to the time of day, the day of the week, the traffic load as detected by traffic sensor 1230, light detected by photo-sensor 1110, the status of power source 640, or the like.

From the description of the various embodiments of the process and apparatus set forth supra, it will be apparent to one of ordinary skill in the art that variations and additions to the embodiments can be made without departing from the principles of the present invention. For example, bulb groups 625 and 628 may be used to form patterns other than those shown. The number of bulb 520 shown in lamp 510 are illustrative only and not meant to be limiting. Typical implementations of lamp 510 will have more bulbs 520 than shown in the FIGs. A larger number of bulbs will improve the resolution of displayed patterns. In an alternative embodiment bulb 520 and some associated electrical connections are replaced by fiber optics. In this embodiment, patterns meaningful to traffic control are formed by arranging outputs of the fiber optics. Traffic controlled by traffic signal 550 includes travel by vehicular locomotion means such as truck, automobile, bicycle, aircraft, railroad, or the like. Traffic signal 550 optionally includes three or more lamps 510.

I claim:

1. A traffic signal comprising:

a support structure;

a housing supported by the support structure;

an electronic circuit;

a first lamp at least partially contained within the housing; and a second lamp at least partially contained within the housing and configured to display, responsive to the electronic circuit, a plurality of patterns having a plurality of meanings to traffic control.

2. The traffic signal of claim 1, wherein the plurality of patterns displayed by the second lamp are displayed in essentially the same color.

3. The traffic signal of claim 1, wherein the second lamp includes a first group of bulbs and a second group of bulbs, each of the first group of bulbs and the second group of bulbs disposed to display a different pattern of the plurality of patterns, and a member of the first group of bulbs is also a member of the second group of bulbs.

4. The traffic signal of claim 1, further comprising a third lamp at least partially contained within the housing and linearly disposed with the second lamp and the first lamp.

5. The traffic signal of claim 1, wherein the first lamp is configured to display a plurality of patterns responsive to the electronic circuit.

6. The traffic signal of claim 1, wherein a color displayed by the second lamp is deducible from the position of the second lamp in the housing.

7. The traffic signal of claim 1, wherein the plurality of patterns include a filled circle and an arrow.

8. The traffic signal of claim 1, wherein the plurality of patterns include at least one of the set consisting of a filled red circle, an arrow, a bar pattern, a cross pattern, and a polygon pattern.

9. A traffic signal comprising:

a first housing;

a first group of bulbs disposed to display a first pattern meaningful to traffic control;

a second group of bulbs having at least one bulb in common with the first group of bulbs and disposed to display a second pattern meaningful to traffic control;

a first lamp at least partially contained within the first housing and including the first group of bulbs and the second group of bulbs; and an electronic circuit configured to control a state of bulbs in the first group of bulbs separately from a state of bulbs in the second group of bulbs.

10. The traffic signal of claim 9, wherein the first group of bulbs is a subset of the second group of bulbs.

11. The traffic signal of claim 9, wherein the first pattern includes an arrow.

12. The traffic signal of claim 9, wherein the first pattern includes an arrow pointing in a first direction and the second pattern includes an arrow pointing in a second direction.

13. The traffic signal of claim 9, wherein the first pattern includes an arrow and the second pattern includes a filled circle.

14. The traffic signal of claim 9, wherein the first pattern includes at least one pattern from the set consisting of a filled red circle pattern, an arrow pattern, a bar pattern, a cross pattern, and a polygon pattern.

15. The traffic signal of claim 9, wherein the first group of bulbs and the second group of bulbs are configured to exhibit essentially the same color.

16. The traffic signal of claim 9, further including a second lamp at least partially contained within the first housing.

17. The traffic signal of claim 9, further comprising a support structure configured to support the first housing.

18. The traffic signal of claim 9, further comprising a second housing including at least a second lamp and a third lamp, and a plurality of support structures configured to support the first housing and the second housing, the electronic circuit being further configured to determine states of bulbs within the second lamp and the third lamp.

19. The traffic signal of claim 9, further comprising an array of lenses disposed to direct light from the first group of bulbs.

20. The traffic signal of claim 9, further comprising a barrier configured to prevent light from a first bulb that is a member of the first group of bulbs from striking a second bulb that is a member of the second group of bulbs.

21. The traffic signal of claim 9, further comprising a photo-sensor configured to regulate the brightness of the first lamp by changing a number of bulbs within the first lamp that are lit.

22. The traffic signal of claim 9, further comprising a traffic sensor, the electronic circuit being further configured to determine the lit/unlit state of the first bulb group responsive to the traffic sensor.

23. The traffic signal of claim 9, further comprising a console including the electronic circuit.

24. The traffic signal of claim 9, wherein the electronic circuit includes a plurality of switches in series, the switches configured to control electrical power applied to the first bulb group and the second bulb group.

25. The traffic signal of claim 9, wherein the electronic circuit includes a plurality of switches in parallel, the switches configured to control electrical power applied to the first bulb group and the second bulb group.

26. A traffic signal comprising:

a support structure;

a housing supported by the support structure;

a first lamp at least partially contained within the housing;

a second lamp at least partially contained within the housing;

an electronic circuit including a plurality of switches, with on/off positions configured to control the second lamp;

a first on/off state of the plurality of switches configured such that the second lamp displays a first pattern meaningful to traffic control; and a second on/off state of the plurality of switches configured such that the second lamp displays a second pattern meaningful to traffic control.

27. The traffic signal of claim 26, wherein the plurality of switches is responsive to the availability of power from a power grid.

28. The traffic signal of claim 26, wherein the plurality of switches is responsive to traffic flow.

29. The traffic signal of claim 26, wherein the plurality of switches is responsive to a day of the week or a time of day.

30. The traffic signal of claim 26, wherein the first pattern includes a filled circle.

31. The traffic signal of claim 26, wherein the plurality of switches is responsive to a photo-sensor.

32. The traffic signal of claim 26, wherein the first pattern and the second pattern are displayed using an arrangement of fiber optic outputs.

33. The traffic signal of claim 26, wherein a color of the first pattern is deducible using the position of the second lamp relative to the first lamp.

34. The traffic signal of claim 26, further including a second housing including a third lamp and a forth lamp, the third lamp and the forth lamp being responsive to the electronic circuit.

35. A traffic signal comprising:

a housing;

a first group of bulbs disposed to display a first pattern meaningful to traffic control;

a second group of bulbs disposed to display a second pattern meaningful to traffic control the second group of bulbs having at least one bulb in common with the first group of bulbs;

a lamp at least partially contained within the housing and including the first group of bulbs and the second group of bulbs;

an array of lenses, including more than one lens, disposed to direct light generated by the first group of bulbs in a first direction and to direct light generated by the second group of bulbs in a second direction; and an electronic circuit configured to control the first group of bulbs.

36. The traffic signal of claim 35, wherein electronic circuit is configured to alternatively energize the first group of bulbs and the second group of bulbs.

37. A method of controlling traffic including the steps of:

supporting a traffic signal having a plurality of lamps;

placing the traffic signal in a first state in which a first lamp, of the plurality of lamps, displays a first pattern meaningful to traffic control; and placing the traffic signal in a second state in which the first lamp displays a second pattern meaningful to traffic control, the second pattern being either a filled circle pattern, an arrow pattern, a bar pattern, a polygon pattern, or a cross pattern.

38. The method of controlling traffic of claim 37, wherein the first pattern is an arrow.

39. The method of controlling traffic of claim 37, wherein the first pattern is an arrow, the second pattern is a filled circle, and both the first pattern and the second pattern are displayed in essentially the same color.

40. The method of controlling traffic of claim 37, wherein the first lamp includes a plurality of fiber optics.

41. The method of controlling traffic of claim 37, further including the steps of sensing traffic flow and displaying the first pattern responsive to the sensed traffic flow.

42. The method of controlling traffic of claim 37, wherein the first lamp includes a plurality of bulbs divided into a plurality of bulb groups separately controllable.

43. The method of controlling traffic of claim 42, wherein a bulb is a member of more than one bulb group in the plurality of bulb groups.

44. The method of controlling traffic of claim 42, further including the steps of sensing light incident on the traffic signal and powering one of the plurality of bulb groups responsive to the sensed light.

45. The method of controlling traffic of claim 42, further including the steps of determining the availability of a power source and powering one of the plurality of bulb groups responsive to the availability.

46. The method of controlling traffic of claim 42, further including the step of powering the first bulb group responsive to a time of day or a day of the week.

47. A method of controlling traffic including the steps of:

placing a traffic signal in a first state in which a first lamp, at least partially contained within a housing, displays a filled green circle and a second lamp, at least partially contained within the housing, displays no lit pattern;

placing the traffic signal in a second state in which the first lamp displays a green arrow, and the second lamp displays a filled red circle; and placing the traffic signal in the first state again.

48. The method of claim 47, further including a step of placing the traffic signal in a third state in which the second lamp displays a red arrow.

49. The method of claim 47, further including a step of determining a pattern to display in the first lamp responsive to a time of day or day of the week.

50. A method of controlling traffic including the steps of:

placing a traffic signal in a first state in which a first lamp, at least partially contained within a housing, displays a filled green circle, and a second lamp, at least partially contained within the housing, displays a red arrow; and placing the traffic signal in a second state in which the first lamp displays a green arrow and the second lamp displays no lit pattern.

51. The method of claim 50, further including a step of placing the traffic signal in a third state in which the second lamp displays a filled red circle.

52. The method of claim 50, wherein the traffic signal includes more than two lamps at least partially contained within the housing.

53. The method of controlling traffic of claim 50, wherein the color of the first lamp can be deduced using the position of the first lamp relative to the second lamp.

54. The method of claim 50, further including steps of measuring a traffic flow and determining a pattern to display in the first lamp responsive to the measured traffic flow.

55. A method of attracting attention to a traffic signal comprising the steps of:

supporting a traffic signal having a plurality of lamps, a first lamp of the plurality of lamps including two or more separately controllable bulb groups, each bulb group configured to display essentially the same color and including more than one bulb;

placing the traffic signal in a first state in which the first lamp displays a pattern meaningful to traffic control; and powering one of the separately controllable bulb groups on and off without changing the meaning of the pattern displayed by the first lamp.

56. The method of claim 55 wherein the separately controllable bulb groups each include at least two LEDs.

57. The method of claim 55, wherein the separately controllable bulb group powered on and off includes bulbs at the outer edge of the pattern.

58. A traffic signal comprising:

a first housing including a first lamp and a second lamp;

a second housing including a third lamp and a forth lamp;

a support structure configured to support the first and second housing; and means for displaying a plurality of patterns, meaningful to traffic control, within the first lamp, the plurality of patterns including at least two patterns from a set of patterns consisting of a filled circle pattern, an arrow pattern, a bar pattern, a polygon pattern, and a cross pattern.

59. A traffic signal comprising:

a support structure;

a housing supported by the support structure;

an electronic circuit;

a first lamp at least partially contained within the housing and configured to display, responsive to the electronic circuit, a plurality of patterns within the first lamp, each pattern of the plurality of patterns having a different meaning to traffic control;

a second lamp at least partially contained within the housing, the electronic circuit configured to light the first lamp and the second lamp at the same time; and a third lamp at least partially contained within the housing, a color of the third lamp deducible using the position of the third lamp relative to the first lamp and to the second lamp.

60. The traffic signal of claim 59, wherein the plurality of patterns include an arrow pattern and a filled circle pattern.

61. The traffic signal of claim 59, further including means for selecting which of the plurality of patterns to display within the first lamp.

* * * * *

UNITED STATES PATENT AND TRADEMARK OFFICE

CERTIFICATE OF CORRECTION

PATENT NO. : 6,809,655 B1
DATED : October 26, 2004
INVENTOR(S) : Steven M. Colby It is certified that error appears in the above-identified patent and that said Letters Patent is hereby corrected as shown below:

Title page,
Item [76], Inventors, should read -- P.O. Box 52033, Palo Alto, CA (US) 94303 -- not "P.O. Pox 52033, Santa Clara, CA (US) 94303"

Signed and Sealed this

Twenty-first Day of June, 2005

JON W. DUDAS
*Director of the United States Patent and Trademark Office*